US005359395A

United States Patent [19]

Shimura et al.

[11] Patent Number: 5,359,395

[45] Date of Patent: Oct. 25, 1994

[54] CONTACT CHARGE SUPPLY DEVICE

[75] Inventors: Hidetsugu Shimura; Hajime Kurihara; Akihiko Ikegami; Hiroshi Tanaka; Kenjirou Yoshioka, all of Nagano, Japan

[73] Assignee: Seiko Epson Corporation, Tokyo, Japan

[21] Appl. No.: 147,572

[22] Filed: Nov. 5, 1993

[30] Foreign Application Priority Data

| | | | |
|---|---|---|---|
| Nov. 6, 1992 | [JP] | Japan | 4-297350 |
| Jan. 20, 1993 | [JP] | Japan | 5-007897 |
| Jul. 27, 1993 | [JP] | Japan | 5-185348 |
| Sep. 28, 1993 | [JP] | Japan | 5-241735 |

[51] Int. Cl.[5] ..... G03G 15/02

[52] U.S. Cl. ..... 355/219; 355/221; 355/274; 361/225; 361/230; 361/235

[58] Field of Search ..... 355/219, 221, 222, 274, 355/276, 277, 303; 361/225, 230, 235

[56] References Cited

U.S. PATENT DOCUMENTS

| | | | |
|---|---|---|---|
| 5,126,913 | 6/1992 | Araya et al. | 361/225 |
| 5,150,165 | 9/1992 | Asai | 355/274 |

*Primary Examiner*—Matthew S. Smith
*Attorney, Agent, or Firm*—Sughrue, Mion, Zinn, Macpeak & Seas

[57] ABSTRACT

A contact charge supply device for externally controlling the charges, which are supplied to a member to be charged by bringing a contact member appled with an external voltage into contact with the member to be charged, which at least includes an underlayer, and holds the following inequality $$\log(R) \geqq \log\{Rp \times (Va - Vt)/Vt\} + (\alpha - \beta) \times \log(S/s) + \gamma \times \log(i/I)$$

where $|Va| \geqq |Vt|$,

Va (V): voltage applied to a contact member in contact with the member to be charged; I ($\mu$A): current flowing from the contact member to the member to be charged; S ($cm^2$): contact area of the member to be charged and the contact member; R ($\Omega$): resistance of the contact member when current I ($\mu$A) is fed to an area corresponding to the contact area S ($cm^2$) of the contact member; $\gamma$: current dependency of the resistance of the contact member; $1-\beta$: area dependency of the resistance of the contact member; s ($cm^2$): area of a defective part of the member to be charged; Vt (V): breakdown voltage of the underlayer; i ($\mu$A): current flowing into an area of the underlayer corresponding to the contact area S ($cm^2$) when a voltage, slightly lower than the breakdown voltage Vt (V), is applied to that area; Rp ($\Omega$): resistance of the underlayer when the current i ($\mu$A) flows into the area of the underlayer corresponding to the contact area S ($cm^2$) when a voltage, slightly lower than the breakdown voltage Vt (V), is applied to that area; $1-\alpha$: area dependency of the resistance of the underlayer.

31 Claims, 12 Drawing Sheets

CONTACT CHARGE SUPPLY DEVICE

BACKGROUND OF THE INVENTION

1. Field of the Invention

The present invention relates to a charge supply device of the contact type in use with an image forming apparatus, such as a printer, a video printer, a facsimile, a copying machine, or a display, and more particularly to a contact charging device and a contact transfer device in use with the image forming apparatus.

More specifically, the invention relates to a contact charging device for charging or discharging a member to be charged by bringing a charging member applied with an external voltage into contact with the member to be charged, and a contact transfer device for transferring developer onto a transferred-image recording media from the member to be charged when the transferred-image recording media passes through a space between a transfer member applied with an external voltage and the member to be charged. The charging member and the transfer member will be referred to as a "contact member" hereinafter.

2. Discussion of the Conventional Art

In the image forming apparatus based on the electrostatic electrophotography system, a latent electrostatic image is formed on a photoreceptor drum, toner is attracted to the latent image, and the toner image formed is transferred onto a transferred-image recording media.

The photoreceptor drum used in the electrophotography system is constructed such that an underlayer is formed on the surface of a drum as a base, and a photoreceptor layer whose electric conductivity varies in response to light is formed on the underlayer. In some cases, the photoreceptor layer is layered directly on the surface of the drum, not using the underlayer.

The drum is made of such a metal as to have a required rigidity and to allow a hard, electric insulating film to easily be formed on the surface thereof. Such a metal is typically aluminum. The underlayer is usually an oxide film or an electric insulating film, which is formed on the surface of the drum.

Organic or inorganic material, used for the photoreceptor layer, exhibits an electrical insulation to such a degree as to retain charges when it is not exposed to light, and as to release charges therefrom when it is exposed to light. When a material making the photoreceptor layer is an organic material, the photoreceptor layer is formed by immersing a drum with the underlayer formed thereon in a preparation liquid that is formed by dissolving the organic material into a solvent. When a material making the photoreceptor layer is an inorganic material, the photoreceptor layer is formed by vapor depositing the inorganic material on the underlayer formed on the drum.

The photoreceptor drum thus constructed is charged at a fixed potential by a corona charging device, a contact charging device, or the like. Under this condition, the photoreceptor layer on the drum is exposed to light beams or an optical image patterned according to image data in order to form a latent electrostatic image thereon. The electric resistance values in only the portions of the photoreceptor layer which are exposed to the light are selectively reduced, so that charges present on the surface disappear and the potential thereon drops.

Charged toner is brought into contact with the photoreceptor layer bearing the latent electrostatic image thereon, so that the toner is attracted to only the portions exposed or not exposed to the light by an electrostatic force, thereby forming a toner pattern on the photoreceptor layer.

Then, a transferred-image recording media is moved toward the surface of the photoreceptor drum in synchronism with the rotation of the drum bearing the toner image on the surface thereon. Then, the transferred-image recording media is charged in the polarity opposite to the polarity of the charged toner. The toner pattern on the drum is attracted to the transferred-image recording media, so that the toner pattern is recorded on the transferred-image recording media.

The device for charging the photoreceptor drum, the discharging device for removing the residual charge on the drum, and the transferring device for transferring the toner pattern on the transferred-image recording media belong to the devices for supplying and removing charges to and from the drum. By convention, the called corona charging device, which utilizes particles charged by the corona discharging, is used for those devices.

The use of the corona charging devices inevitably generate ozone, which contaminates air. To avoid this, contact charging devices and contact transfer devices, which generate an extremely small amount of ozone, have been used recently.

In the contact charging device, a brush of conductive fibers or a roller made of conductive elastic material, being applied with external voltage, is brought into contact with the surface of the photoreceptor drum, while the contact member, i.e., the brush or the roller, is being moved relative to the drum. A minute spark is generated in a gap between the contact member and the drum surface, which is formed when they approach to each other or separate from each other. Through this process, the photoreceptor drum is charged.

In the contact transfer device, a brush of conductive fibers or a roller made of conductive elastic material, being applied with external voltage, is made to approach to each other in a state that a transferred-image recording media is placed therebetween. At this time, the contact member is being moved relative to the drum. A minute spark is generated in a gap between the contact member and the transferred-image recording media, which is formed when they approach to each other or separate from each other. Through this process, the image on the photoreceptor drum is transferred onto the transferred-image recording media.

When the transferred-image recording media is not present between the contact member and the drum surface, a voltage for cleaning the contact member (causing the toner adhered to the contact member to move to the drum surface) is applied thereto to clean the contact member.

The discharge phenomenon is used also in the contact charging device and the contact transfer device. Accordingly, a voltage of approximately 0.5 to 1.5 kV, lower than that for the corona discharge, is applied between the contact member and the photoreceptor drum. To keep the breakdown voltage of 0.5 to 1.5 kV, the voltage must be properly distributed into the photoreceptor layer and the underlayer so as not to damage them.

Where the photoreceptor layer has a defective part or parts and a pinhole or holes with dusty material, i.e., foreign material attaching thereto, and those provide current paths, the current concentrically flows through those current paths.

When the contact member comes in contact with the defective parts or the pinholes, the voltage applied to the contact member causes current to flow to the conductive paths formed by the defective parts and the foreign materials in the pinholes or the defective parts since the impedance of the conductive paths is lower than that of the remaining portions of the photoreceptor layer. At this time, no discharge phenomenon occurs between them, or the contact member and the photoreceptor layer.

If the current flowing into the pinholes exceeds a current value predetermined for the related circuit, the voltage applied to the contact member, or the charging member, drops, so that no discharge takes place in the gap between the charging member and the photoreceptor layer. As a result, only the contact area of a part of the photoreceptor layer, which includes the pinholes and extends in the axial direction, and is in contact with the charging member, suffers from poor discharge. The poor discharge part appears as a white stripe in the normal development and as a black stripe in the reversal development. This considerably reduces the image quality.

Additionally, the current concentrically flowing into the extremely small areas is excessively large. This excessively large current heats the charging member in these areas and the foreign material in and around the pinholes. The material of the charging member is changed in quality and the pinholes of the photoreceptor layer is enlarged, possibly creating serious problems in the machine.

To solve the problems, the techniques to limit the lower limit value of the resistance of the charging member have widely been used as disclosed in Published Unexamined Japanese Patent Application Nos. Sho. 56-132356, Sho 58-49960 and Sho. 64-73365, for example. In one of the techniques, the volume resistivity of the charging member is set within $10^5$ to $10^{11}$ (Ωcm).

Techniques using the charging member, which is multilayered such that the volume resistivity of the outer layer thereof is larger than that of the inner layer, have been proposed in Published Unexamined Japanese Patent Application Nos. Sho. 64-73364 and Hei. 4-138477, and U.S. Pat. No. 5,126,913, for example.

Specifically, Published Unexamined Japanese Patent Application No. Hei. 4-138477 discloses a charging member having such a multilayered structure that the surface layer exhibits an anisotropic property of conductivity and has $10^5$ Ω or more along the surface thereof. U.S. Pat. No. 5,126,913 uses a power source of such a large capacity as to keep the power source output constant even if the current concentrates at the pinholes.

Many proposals have been made on the technique to lay an underlayer between the photoreceptor layer and the drum body. Those proposals discuss mainly improvements on the adhesion of the photoreceptor layer to the conductive layer or the drum, the coating of the photoreceptor layer, and the dark/light decay characteristics of the photoreceptor layer. Among those proposals, Published Unexamined Japanese Patent Application No. Sho. 61-179464 discloses a technical idea in which the lower limit value of the divided charged potential for the underlayer (or the intermediate layer) is set at 1 V, in order to suppress the formation of pinholes in the photoreceptor layer by the discharge.

Also in the contact transfer device, as in the contact charging device, when the current flowing into the pinholes exceeds a current value predetermined for the related circuit, the voltage applied to the transferred-image recording media drops, so that no discharge takes place in the gap between the transferred-image recording media and the transfer member. As a result, only the contact area of a part of the photoreceptor layer, which includes the pinholes and extends in the axial direction suffers from poor transfer. The transfer member is changed in quality and the pinholes of the photoreceptor layer are enlarged, possibly creating serious problems in the machine.

The inventors of the present Patent Application, after carefully studying the problems of those devices in connection with the conventional techniques, confirmed the following facts. The conventional technique cannot suppress or eliminate such a phenomenon that when the contact member comes in contact with the defective part and/or the pinholes of the photoreceptor layer, a current, which is in excess of a current value calculated on the basis of the volume resistivity of the contact member, flows into the defective part and/or the pinholes. Accordingly, poor charging or transfer inevitably takes place over the entire contact area across the photoreceptor layer with the contact member. The resultant image is poor. Further, a situation that the current flowing into the pinholes heats the contact member or the pinholes of the photoreceptor layer, thereby deteriorating the contact member or enlarging the pinholes, is also inevitable.

SUMMARY OF THE INVENTION

Accordingly, a first object of the present invention is to prevent image quality deterioration, and damage to the contact member and the photoreceptor layer by an overcurrent flowing into the defective part and the pinholes.

A second object of the present invention is to provide a novel contact charging device which is free from the deterioration of the image quality, the erroneous operation of the electrical system, and the damage of the device components.

A third object of the present invention is to provide a contact charging device which is able to charge a charged member stably and uniformly.

A fourth object of the present invention is to provide a contact transfer device which is free from the deterioration of the image quality, the erroneous operation of the electrical system, and the damage of the device components.

To achieve the above objects, there is provided a contact charge supply device for controlling the charges, which are supplied to a member to be charged by bringing a contact member applied with an external voltage into contact with the member to be charged, characterized in that any of the following inequalities holds $$\log(R) \geqq \log\{Rp \times (Va - Vt)/Vt\} + (\alpha - \beta) \times \log(S/s) + \gamma \times \log(i/I) \quad \text{(A)}$$

where $|Va| > |Vt|$, $$a + b \geqq Va \times 10^6/j \quad \text{(B)}$$

where $$\log(a) = \log(R) + (\beta - \gamma) \times \log(S/s) - \gamma \times \log(j/I)$$

$$\log(b) = \log(Rp) + \alpha \times \log(S/s)$$

$$\log(R) \geqq \log(Va \times 10^6/k) + (\gamma - \beta) \times \log(S/s) + \gamma \times \log(k/I) \quad \text{(C)}$$

In the above inequalities,

Va (V): voltage applied to a contact member in contact with the member to be charged I ($\mu$A): current flowing from the contact member to the member to be charged S ($cm^2$): contact area of the member to be charged and the contact member R ($\Omega$): resistance of the contact member when current I ($\mu$A) is fed to an area corresponding to the contact area S ($cm^2$) of the contact member $\gamma$: current dependency of the resistance of the contact member $1-\beta$: area dependency of the resistance of the contact member s ($cm^2$): area of a defective part of the member to be charged Vt (V): breakdown voltage of an underlayer i ($\mu$A): current flowing into an area of the underlayer corresponding to the contact area S ($cm^2$) when a voltage, slightly lower than the breakdown voltage Vt (V), is applied to that area Rp ($\Omega$): resistance of the underlayer when the current i ($\mu$A) flows into the an area of the underlayer corresponding to the contact area S ($cm_2$) when a voltage, slightly lower than the breakdown voltage Vt (V), is applied to that area j ($\mu$A): current allowed to flow into an area of the underlayer corresponding to the defective part area s ($cm^2$)

k ($\mu$A): current allowed to flow into a defective part of the member to be charged $1-\alpha$: area dependency of the resistance of the underlayer In a case where, under the condition as mentioned above, the member to be charged is charged or discharged and a toner pattern is transferred from the member to be charged to a transferred-image recording media, and a photoreceptor drum has minute defects passed unmarked in the inspection before the products are delivered, the underlayer will not be destroyed since the divided voltage applied to the underlayer is not in excess of the breakdown voltage of the underlayer. If the photoreceptor drum has defective parts and/or pinholes, it is possible to limit the current flowing into the defective parts and/or pinholes to such a current value as not to enlarge them. Therefore, the invention successfully prevents black or white stripes from appearing on the resultant image, and the poor transfer.

DESCRIPTION OF THE PREFERRED EMBODIMENTS

Figure 1:
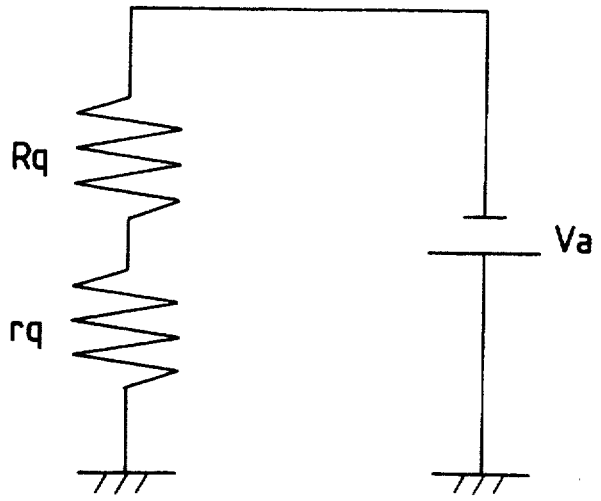
FIG. 1 is an equivalent circuit of a defective part on a photoreceptor layer of a member to be charged according to the present invention.

The preferred embodiments of the present invention will be described with reference to the accompanying drawings.

The defects of a photoreceptor layer to which the present invention is directed will be described.

The defects that would be caused in the photoreceptor drum may be categorized into many types. A defect 75 shown in FIG. 16(*a*) exists only in the surface region of a photoreceptor layer 72 of the photoreceptor drum, not reaching an underlayer 71. A blow hole 76 shown in FIG. 16(*b*) exists in the photoreceptor layer 72. A defect 77 shown in FIG. 16(*c*) passes through the photoreceptor layer 72 to reach the underlayer 71. A defect, or a pinhole 78, shown in FIG. 16(*d*), passes through the underlayer 71 and the photoreceptor layer 72 and reaches a drum body (or the conductive layer) 70.

Most of the defects reaching the drum body 70 are surely checked by the inspection before delivery because the opening diameters of the defects are large. The products suffering from such defects are removed. Usually, the products after delivered are almost free of the defects. The defects as shown in FIGS. 16(*a*) to 16(*c*), too small to mark in the inspection, may grow to be large to pass through the underlayer during the use of it, as will be described later.

The defect ranging from the photoreceptor layer to the drum body, viz., a defect destroying both the photoreceptor layer and the underlayer, will be referred to as a "pinhole".

Figure 17A:
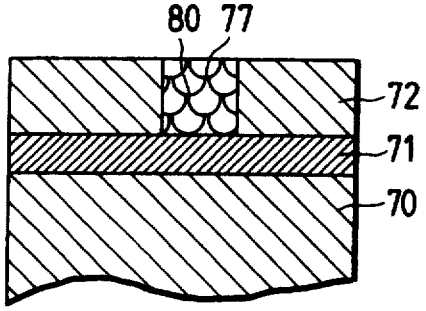
FIGS. 17(*a*) and 17(*b*) are diagrams showing models of conductive paths through which current concentrically flows from a contact member into a defect or a pinhole formed in the photoreceptor drum.
Figure 17B:
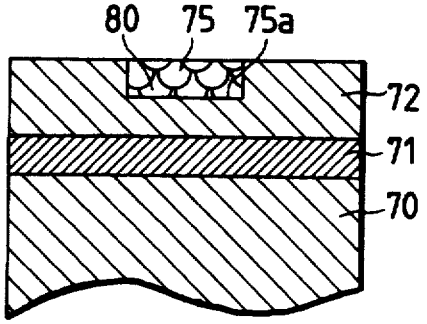

When a electrophotographic process is carried out using a photoreceptor drum in which a defect exists only in the photoreceptor layer, toner and dusty material enter the defect 77 of the photoreceptor layer as shown in FIG. 16(*c*) to form a conductive path 80 ranging from the surface of the photoreceptor layer to the underlayer (FIG. 17(*a*)). The same enter the defect 75 of the photoreceptor layer as shown in FIG. 16(*a*), thereby forming a conductive path 80 (FIG. 17(*b*)). In the defects, even such tiny defects (FIGS. 16(*a*) and 16(*b*)), a thinned part 75*a* of the photoreceptor layer 72 is formed. The divided voltage assigned to the photoreceptor layer 72 is small, so that the voltage applied to the underlayer 71 is large. To extremes, the underlayer will be destroyed.

Specifically, if the conductive path 80 is once formed, the voltage to be shared to the photoreceptor layer is almost applied to the underlayer in the charging, transfer, and discharging stages. An overvoltage in excess of the breakdown voltage acts on the underlayer. Consequently, the underlayer will be dielectrically broken down.

Then, current flows from the contact member applied with voltage through this conductive path 80 into the drum body 70. At this time, the current larger than a normal current concentrically flows into a narrow part, or the defective part. Joule heat is generated at this part. The tiny defect grows into a pinhole 78 as shown in FIG. 16(*d*).

The Joule heat damages not only the photoreceptor drum but also the contact member, which generates charges in the charging and transfer steps in the electrophotographic process.

Our study on this mechanism showed the following facts. In order to enable the photoreceptor drum suffering from the defects and/or pinholes, viz., to keep the photoreceptor drum operable in a state that the stain on the image owing to the defects and pinholes is negligible in practical use, the following two conditions must be satisfied:

1) When the defect exists only in the photoreceptor layer, the defect must be confined within the photoreceptor layer. In other words, it should not be grown till it reaches the underlayer.

2) Even if the defect grows into a pinhole, Joule heat caused by the concentric current flowing into the pinhole must be suppressed to such a degree as not to deteriorate the photoreceptor layer and the contact member.

Where those conditions are satisfied, the tiny defect will not grow to cause such a detrimental state as formation of black or white stripes in the image and replacement of parts.

The Joule heat generated in the pinhole is thermal energy proportional in quantity to the product of the resistance in the pinhole and the square of current, which is allowed to flow because of presence of the conductive path formed when toner particles and/or dusty material entering the pinhole is made conductive and the conductive property, although slight, of the photoreceptor layer per se. Therefore, the sum of a resistance of the foreign material put in the pinhole and a resistance in a partial area or region of the photoreceptor layer, which is located near to the pinhole becomes problematic.

In order to prevent the tiny defect of the photoreceptor layer from growing into a pinhole, the current flowing into the pinhole must be restricted. In handling the restrictive control of current, the volume resistivity of the contact member can imperfectly describe the resistance of the contact member. Other key factors must be taken into consideration. One of the key factors is a resistance as seen from the pinhole, viz., a resistance, which varies depending on a current value and an area, of a part contributing to generation of Joule heat in the pinhole. This resistance will be referred to as "pinhole resistance Rq".

The current flowing from the defect of the photoreceptor layer into the photoreceptor drum, of necessity, passes through the underlayer. Accordingly, a resistance in a part of the underlayer at a location corresponding to the defect of the photoreceptor layer, viz., a resistance in the part of the underlayer when seen from the defect of the photoreceptor layer, is another key factor. This resistance will be referred to as "underlayer resistance rq".

These resistance cannot be calculated on the basis of only the volume resistance of the material. The calculation based on the ratio of (voltage acting on each layer)/(flowing current) is right.

Let us consider the pinhole resistance Rq necessary for satisfying the two conditions referred to above:

1) When the defect exists only in the photoreceptor layer, the defect must be confined within the photoreceptor layer. In other words, it should not be grown till it reaches the underlayer.

2) Even if the defect grows into a pinhole, Joule heat caused by the concentric current flowing into the pinhole must be suppressed to such a degree as not to deteriorate the photoreceptor layer and the contact member.

<<Condition 1>>

A model of voltages shared by the underlayer resistance rq (resistance of the underlayer when seen from the defect or the pinhole) and the pinhole resistance Rq at the defective part of the photoreceptor layer is set up. Then, the condition to prohibit a voltage in excess of the breakdown voltage of the underlayer from being applied to the underlayer is obtained.

It can be considered that current flows from the contact member to the underlayer in two routes or conductive paths. The first conductive path is formed by the electrical contact of the contact member and the bottom of the defect of the photoreceptor layer through the toner particles and/or dusty material entering the defect since those are made conductive in the defect as stated above. The second conductive path is the side wall of the defect.

The structure of the surface region including the defect may be equivalently expressed by an electric circuit as shown in FIG. 1.

In the equivalent circuit of FIG. 1, the voltage shared to the underlayer resistance rq can be expressed by $$Va \times rq/(rq+Rq),$$

where Va indicates the voltage applied to the contact member. The voltage shared to the underlayer is lower than the breakdown voltage Vt of the underlayer when the following relation holds $$|Vt| \geqq |Va| \times rq/(rq/+Rq) \text{ when } |Vt| \leqq |Va|.$$

Since $Va \times Vt \geqq 0$, $$Rq \geqq rq \times (Va - Vt)/Vt \quad (1)$$

When $|Vt| > |Va|$, no breakdown of the underlayer takes place. Accordingly, a current value j ($\mu$A) allowed to flow into the defect of the photoreceptor layer is $$|j| \leqq |Va| \times 10^6/Rq+rq).$$

Thence, it is required that the following inequality is satisfied.

$$Rq+rq \geqq Va \times 10^6/j \quad (2)$$

<<Condition 2>>

When the defect grows into a pinhole, the contact member comes in electrical contact with the drum body made of metal through the conductive path by the toner particles and/or dusty material, as described above. In this case, the resistance of the conductive path is considerably low since the underlayer of insulating material as described above is not set between the photoreceptor layer and the drum body.

As in the case of the condition 1, when $|Vt| > |Va|$, $$Rq \geqq Va \times 10^6/k, \quad (3)$$

where Va indicates the voltage applied to the contact member, and k ($\mu$A) is a value of the current allowed to flow into the pinhole, viz., a maximum current value defining the upper limit of Joule heat capable of suppressing a further growth of the pinhole.

Here, the value of the current allowed to flow into the defect or pinhole means the maximum current value defining the upper limit of Joule heat capable of suppressing a further growth of the pinhole and preventing deterioration of the contact member.

It is difficult to actually measure the pinhole resistance Rq and the underlayer resistance rq since the area of the defect or pinhole and the current flowing therethrough as well is extremely small. More adversely, it is found that the pinhole resistance Rq is not coincident with the value calculated by the following equation $$Rq = \rho \times L/s$$

where $\rho$ is the volume resistance of the contact member, thickness of the contact member is L, and the area of a defect (or pinhole) is s.

To be more specific, we found the following facts (1) and (2).

(1) An electrode is formed at an extremely small area of a material of relatively high volume resistivity. Current is concentrically fed into the small area. In this case, the current path expands to be larger than the projection area of the electrode. The resistance value actually measured is smaller than an apparent resistance value, viz., a resistance value led from the conductive path dimensionally coincident with the area of the electrode, by a value corresponding to the expansion of the current distribution. This phenomenon is called a fringe effect. In other words, the resistance value simply obtained by the current flowing from the contact member into the pinhole and the voltage causing that current is smaller than the resistance value of the conductive path per se, that is formed by the foreign materials put into the pinhole.

(2) The voltage vs. current characteristic of the material of relatively high volume resisivity is not linear (or not ohmic) but like the nonlinear semiconductor characteristic. When, under a voltage applied, current flows into the pinhole through the contact member made of such a material, the applied voltage nonlinearly varies depending on the value of the current flowing thereinto. Accordingly, the resistance of the contact member also varies depending on the current flowing into the pinhole.

Accordingly, in handling the pinhole resistance Rq and the underlayer resistance rq, the above two facts must be considered. Otherwise, it is impossible to derive actual conditions for preventing the deterioration of the photoreceptor drum and the contact member.

In the description to follow, the phenomenon as the fact (1) is referred to as "area dependency of resistance". The phenomenon as the fact (2) is referred to as "current dependency of resistance".

The "area dependency of resistance" of the contact member means an area dependency of a resistance when, in a state that measuring electrodes of different areas are brought into contact with a portion where the contact member comes in contact with the photoreceptor layer, currents are fed to between the measuring electrodes and the electrode of the contact member, at the same current densities.

The "area dependency of resistance" of the underlayer means an area dependency of a resistance when, in a state that measuring electrodes of different areas are brought into contact with the photoreceptor drum having only the underlayer, currents are fed to between the measuring electrodes and the conductive layer (or drum body), at the same current densities.

Figure 2:
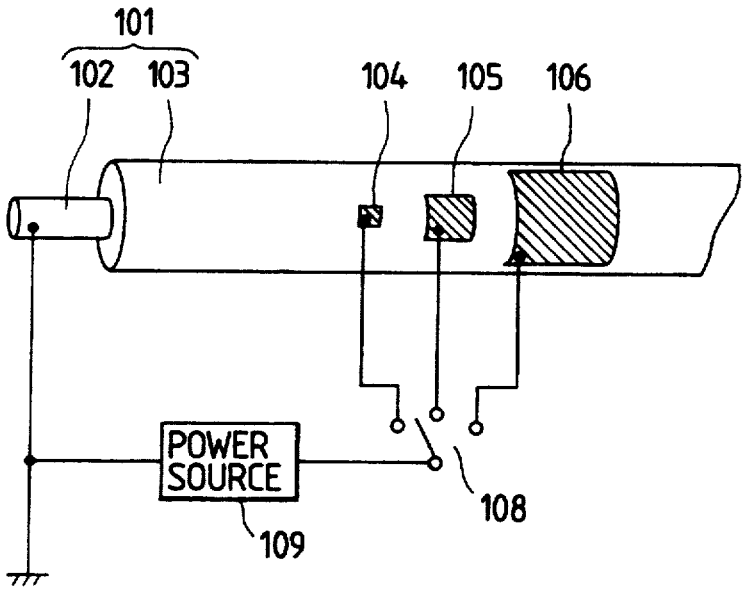
FIG. 2 is a schematic diagram showing a method of measuring the area dependency of resistance of the contact member according to the present invention.

FIG. 2 is a diagram showing a method of measuring the area dependency of resistance of the contact member according to the present invention. In this instance of the embodiment, an object to be measured is a contact member as a one-layer roller.

A contact member 101 consists of a conductive base member 102, shaped like a rod, and a conductive elastic-layer 103 layered on the base member 102. Measuring electrodes 104 to 106 with different areas are pressed against the curved surface of the contact member 101 by means of a pressing means, not shown. Wires led from the measuring electrodes 104 to 106 are connected to a switch 108, which is connected to the conductive base member 102, through a current source 109 of which the voltage can be monitored (SOURCE MEASURE UNIT type 237, manufactured by KEITHLEY corporation, and the current source will be referred to as a power source). The power source 109 feeds current at a fixed current density. The resistance values of the contact member 101 with respect to the measuring electrodes can be measured by operating the switch 108. It is preferable to set the measuring electrodes 104 to 106 on a central portion of the contact member rather than an end portion thereof. The reason for this is that in the central portion of the contact member, the current expanding area is larger than in the end portion thereof, so that the fringe effect can be more distinctly confirmed.

Figure 3:
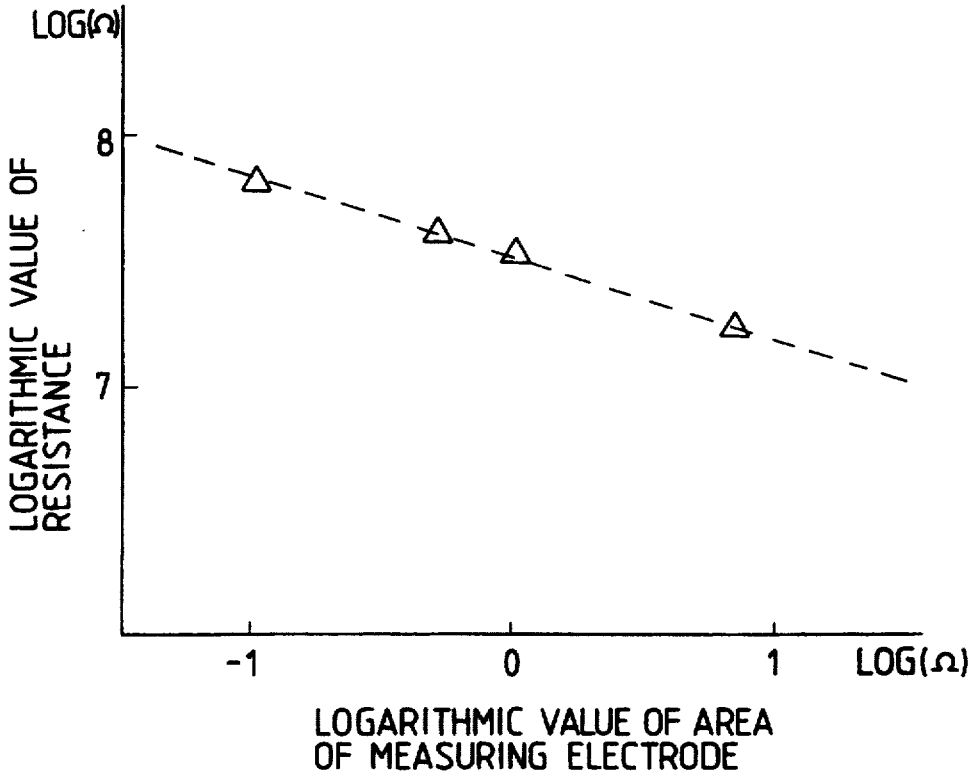
FIG. 3 is a graph showing the area dependency of contact member resistance, measured by the method shown in FIG. 2.

FIG. 3 is a graph showing the area dependency of contact member resistance, thus measured by the method as mentioned above. The abscissa represents logarithmic values of the area of the measuring electrode, while the ordinate, logarithmic values of the measured resistance. The measured values, when plotted on the graph, can be connected by a straight line inclined at $-\beta$. $1-\beta$ is defined as the area dependency of resistance of the contact member.

The resistance of the underlayer was measured in a similar way. The measured resistance values, when plotted, could be connected by a straight line inclined at $-\alpha$, different from $-\beta$. $1-\alpha$ is defined as the area dependency of resistance of the underlayer.

As a matter of course, when the resistance value is reversely proportional to the area, that is, the resistance has no area dependency, $\beta=1$ and $\alpha=1$.

The current dependency of resistance of the contact member means the current dependency of resistance when a measuring electrode of an area, which is substantially equal to an area S ($cm^2$) where the contact member actually comes in contact with the photoreceptor layer, is brought into contact with a portion of the contact member where it is in contact with the photoreceptor layer, and different currents are fed to between the measuring electrode and the conductive base member of the contact member.

Figure 4:
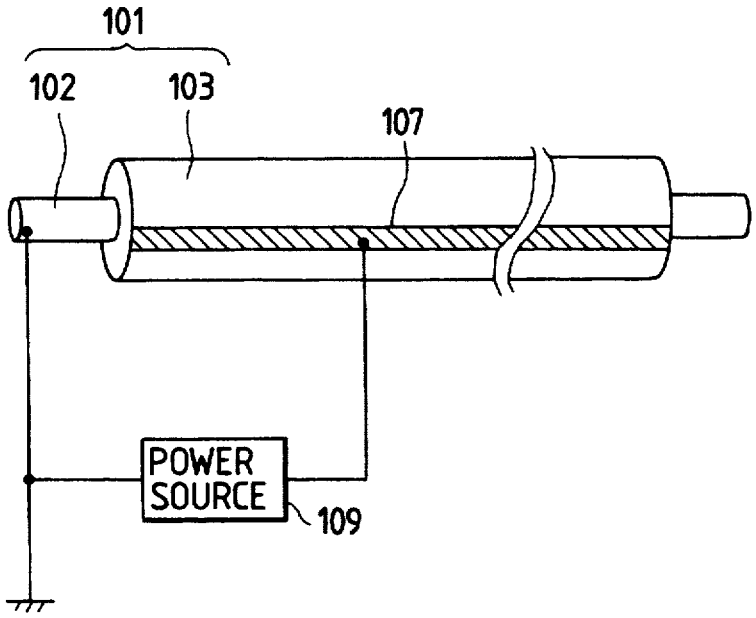
FIG. 4 is a schematic diagram showing a method of measuring the current dependency of resistance of the contact member according to the present invention.

FIG. 4 is a diagram showing a method of measuring the current dependency of resistance of the contact member according to the present invention. In this instance of the embodiment, a contact member is a one-layer roller. In the subsequent drawings, like portions are designated by like reference numerals, for simplicity.

A contact member 101 consists of a conductive base member 102, shaped like a rod, and a conductive elastic-layer 103 layered on the base member 102. A measuring electrode 107 of an area, which is substantially equal to an area S ($cm^2$) where the contact member 101 actually comes in contact with the photoreceptor layer, is pressed against the surface of the contact member 101 by a pressing member, not shown. A power source 109 is connected between the measuring electrode 107 and the conductive base member 102. While varying the current flowing to between the measuring electrode 107 and the conductive base member 102, a load voltage caused between the contact member 101 and the measuring electrode 107 is measured, whereby current values and voltage/current ratios are obtained. Using those values, the current dependency of resistance of the contact member 101 is obtained. The measuring electrode 107 is preferably shaped so that the contact member well contacts with the photoreceptor layer.

Figure 5:
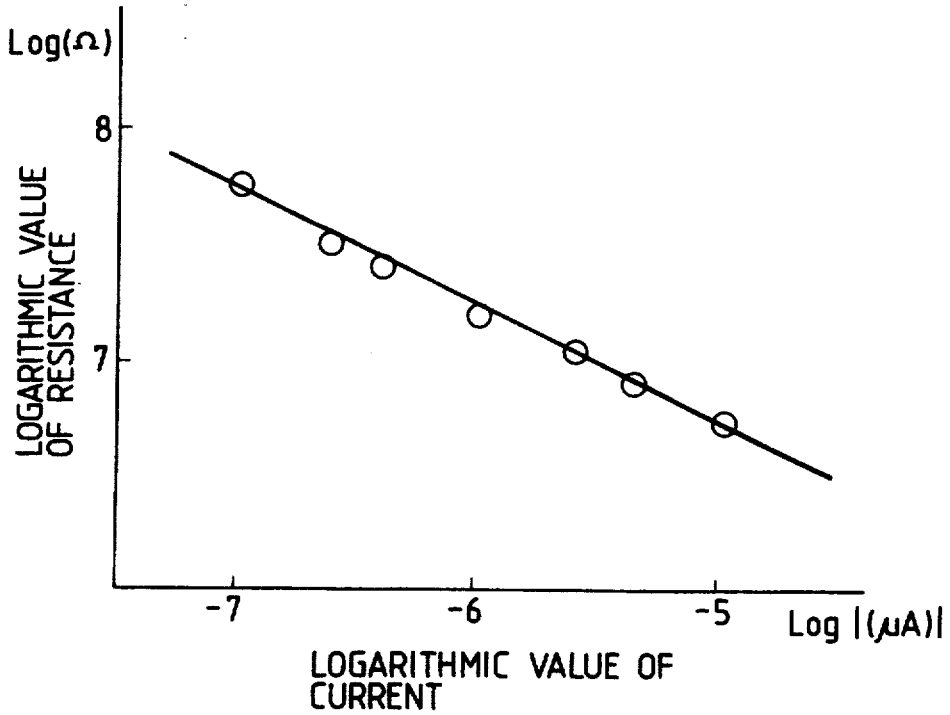
FIG. 5 is a graph showing the current dependency of contact member resistance.

FIG. 5 is a graph showing the current dependency of contact member resistance, measured by the method shown in FIG. 4. The abscissa represents logarithmic values of current, while the ordinate, logarithmic values of resistance. Measured values were plotted on the logarithmic graph.

When the resistance of the contact member has a current dependency, the measured values are connected by a straight line inclined at $-\gamma$. This value y is defined as the current dependency of resistance. As a matter of course, when the resistance has no current dependency, $\gamma=0$.

Description to follow is how to derive the pinhole resistance Rq and the underlayer resistance rq and the conditions for satisfying the formulae (1) to (3)

$$<<|Vt| \leqq |Va| \text{ in the case (1)}>>$$

Let us consider the pinhole resistance Rq.

Figure 6:
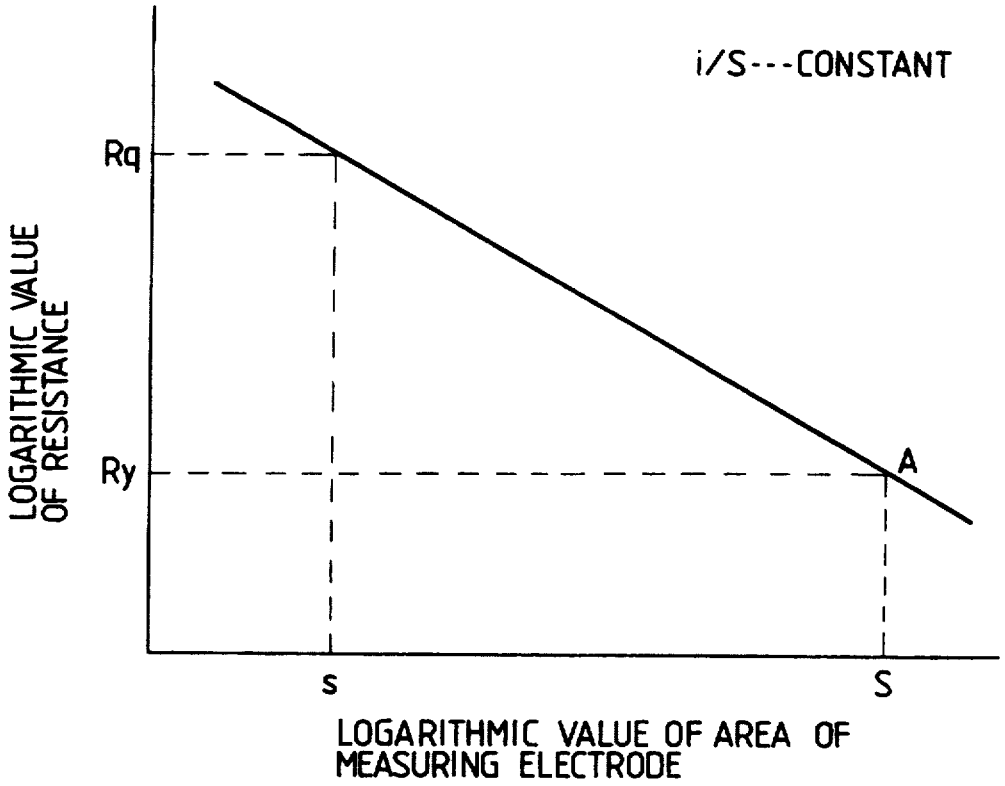
FIG. 6 is a graph showing the area dependency of contact member resistance.

In a graph of FIG. 6 showing the area dependency of contact member resistance, S ($cm^2$) indicates a contact area of an actual photoreceptor layer and a contact member, and i ($\mu A$) represents a current which flows when a voltage, slightly lower than the breakdown voltage Vt (V), is applied to the contact area S ($cm^2$) of the underlayer, and the current density i/S ($\mu A/cm^2$) is constant. A resistance value of the contact member at an area s ($cm^2$) of the defect of the photoreceptor layer is the pinhole resistance Rq. The resistance Rq can be expressed by $$\log(Rq)=\log(Ry)+\beta\times\log(S/s) \quad (4)$$

where Ry is a resistance value of the contact member in the area S, and $-\beta$ is an inclination of the graph.

Figure 7:
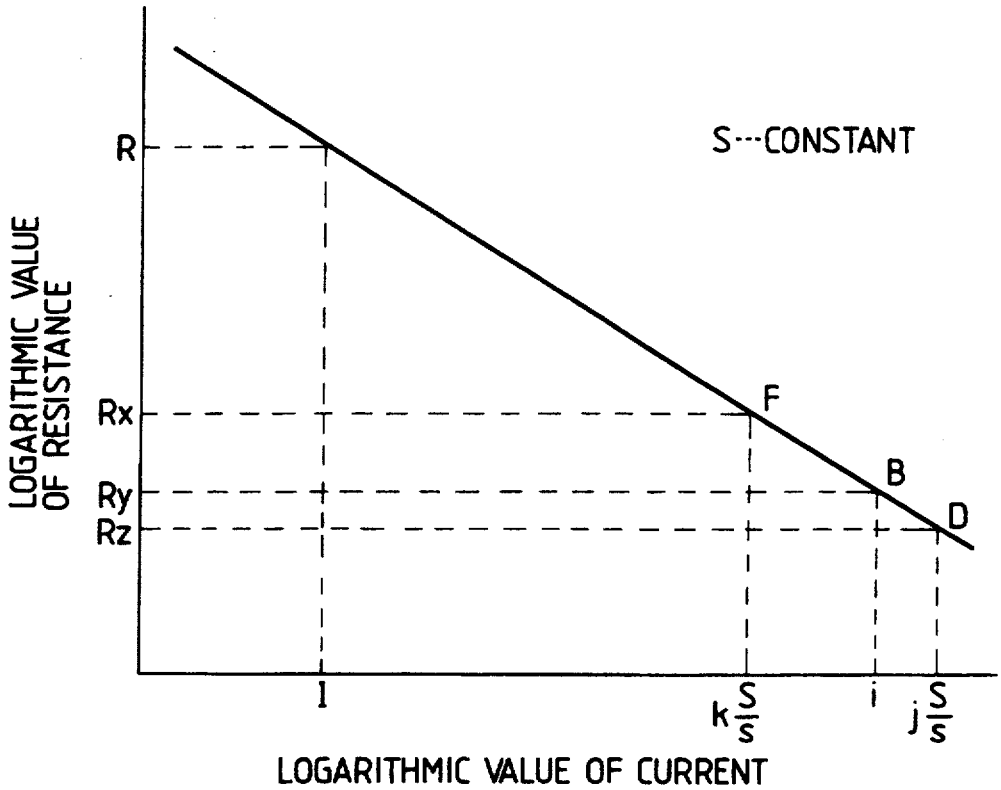
FIG. 7 is a graph showing the current dependency of contact member resistance.

FIG. 7 is a graph showing the current dependency of contact member resistance. As described above, in this graph, the contact area S ($cm^2$) of the actual photoreceptor layer and the contact member is set at a fixed area. In the graph where i ($\mu A$) is a current which flows when a voltage, slightly lower than the breakdown voltage Vt (V), is applied to the contact area S ($cm^2$) of the underlayer, and i/S is a current density i/S, a point A in FIG. 6 corresponds to a point B in FIG. 7. The points A and B indicate a measured area and a current value, respectively, at the same resistance value. The following equation holds $$\log(R)=\log(Ry)+\gamma\times\log(i/I), \quad (5)$$

where current flowing into the photoreceptor layer is I ($\mu A$) when the voltage Va is applied to the contact member, and a resistance value of the contact member when that current flows is R ($\Omega$). Rearranging the equations (4) and (5), we have $$\log(Rq)=\log(R)+\beta\times\log(S/s)-\gamma\times\log(i/I) \quad (6)$$

Consider the underlayer resistance rq in the portion of the underlayer to which the defect of the photoreceptor layer is projected.

As in the case of the pinhole resistance Rq, assuming that current flowing into an area of the underlayer corresponding to the contact area S ($cm^2$) when a voltage, slightly lower than the breakdown voltage Vt (V), is applied to that area is i ($\mu A$), and resistance of the underlayer when the current i ($\mu A$) flows into the area is Rp ($\Omega$), and the area dependency of the resistance of the underlayer is $1-\alpha$, the underlayer resistance rq can be expressed by $$\log(rq)=\log(Rp)+\alpha\times\log(S/s) \quad (7)$$

From the formulae (1), (6) and (7), we have $$\log(R)\geqq\log\{Rp\times(Va-Vt)/Vt\}+(\alpha-\beta)\times\log(S/s)+\gamma\times\log(i/I) \quad (8)$$

<<|Vt|>|Va| in the case (1)>>

Consider first the pinhole resistance Rq.

Figure 8:
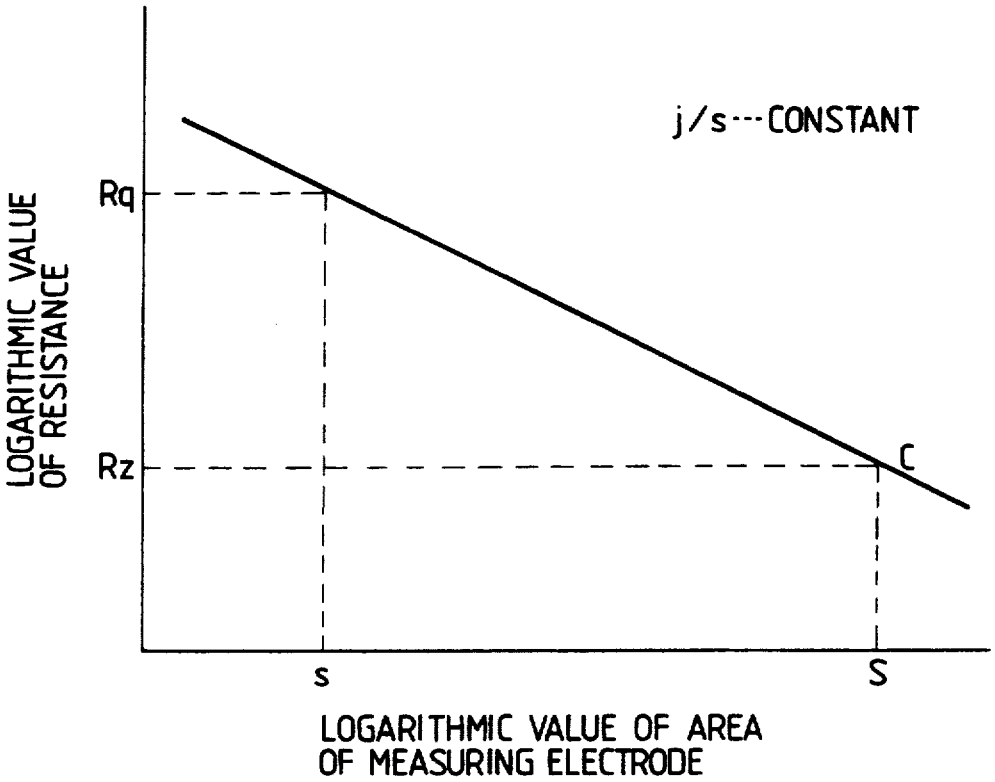
FIG. 8 is a graph showing the area dependency of contact member resistance.

FIG. 8 is a graph showing the area dependency of contact member resistance. In the graph, j ($\mu$A) indicates current allowed to flow into the defective part area s (cm$^2$) of the underlayer, and a current density j/s ($\mu$A/cm$^2$) is constant. A resistance value of the contact member in the area s is the pinhole resistance Rq. Assuming that a resistance value of the contact member in the area S (cm$^2$) is Rz, the following equation holds $$\log(Rq)=\log(Rz)+\beta\times\log(S/s) \quad (9)$$

FIG. 7 is a graph showing the current dependency of contact member resistance. As described above, in this graph, the contact area S (cm$^2$) of the actual photoreceptor layer and the contact member is set at a fixed area. If a current j×S/s ($\mu$A) is fed to the area S (cm$^2$), a point C in FIG. 8 corresponds to a point D in FIG. 7. The points C and D indicate a measured area and a current value, respectively, at the same resistance value Rz. The following equation holds $$\log(R)=\log(Rz)+\gamma\times\log\{j\times S/(I\times s)\} \quad (10)$$

where current flowing into the photoreceptor layer is I ($\mu$A) when the voltage Va is applied to the contact member, and a resistance value of the contact member when that current flows is R ($\Omega$). Rearranging the equations (9) and (10), we have $$\log(Rq)=\log(R)+(\beta-\gamma)\times\log(S/s)-\gamma\times\log(j/I) \quad (11)$$

Consider the underlayer resistance rq in the portion of the underlayer. As described above, the underlayer resistance rq is given by $$\log(rq)=\log(Rp)+\alpha\times\log(S/s) \quad (12)$$

where Rp ($\Omega$) is resistance when current j×S/s (BA) is fed into the area S (cm$^2$), and the area dependency of resistance of the underlayer is $1-\alpha$. From the formulae (2), (11) and (12), we have $$A+B\geqq Va\times10^6/j \quad (13)$$

where $$\log A=\log(R)+(\beta-\gamma)\times\log(S/s)-\gamma\times\log(j/I)$$

$$\log B=\log(Rp)+\alpha\times\log(S/s)$$

<<Case (2)>>

Figure 9:
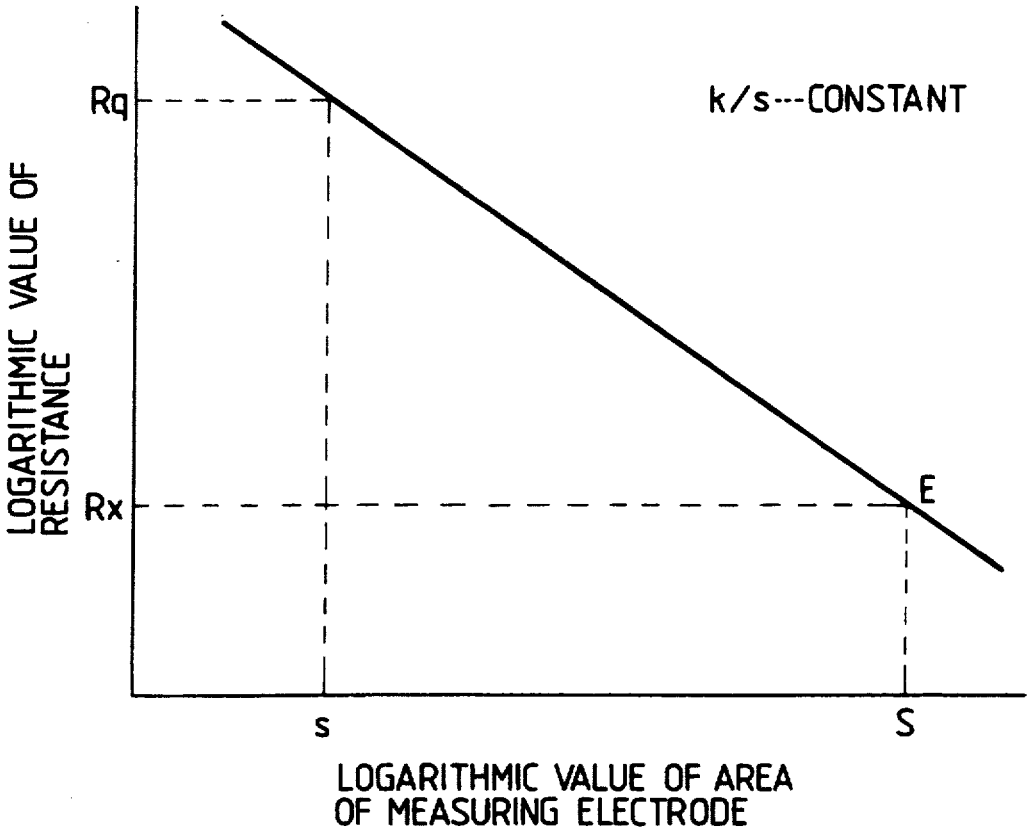
FIG. 9 is a graph showing the area dependency of contact member resistance.

FIG. 9 is a graph showing the area dependency of contact member resistance. In this graph, k ($\mu$A) indicates current allowed to flow into the pinhole part area s (cm$^2$), and a current density k/s ($\mu$A/cm$^2$) is constant. A resistance value of the contact member in the area s is the pinhole resistance Rq. Assuming that a resistance value of the contact member in the area S (cm$^2$) is Rx, the following equation holds $$\log(Rq)=\log(Rx)+\beta\times\log(S/s) \quad (14)$$

FIG. 7 is a graph showing the current dependency of contact member resistance. As described above, in this graph, the contact area S (cm$^2$) of the actual photoreceptor layer and the contact member is set at a fixed area. If a current k×S/s ($\mu$A) is fed to the area S (cm$^2$), a point F (FIG. 7) corresponds to a point E in FIG. 9 The points E . and F indicate a measured area and a current value, respectively, at the same resistance value Rx. The following equation holds $$\log(R)=\log(Rx)+\gamma\times\log(55\ k\times S/(I\times s)\} \quad (15)$$

where current flowing into the photoreceptor layer is I ($\mu$A) when the voltage Va is applied to the contact member, and a resistance value of the contact member when that current flows is R ($\Omega$). Rearranging the equations (14) and (15) we have $$\log(Rq)=\log(R)+(\beta-\gamma)\times\log(S/s)-\gamma\times\log(k/I) \quad (16)$$

From the equations (3) and (16), we have $$\log(R)\geqq\log(Va\times10^6/k)+(\gamma-\beta)\times\log(S/s)+\gamma\times\log(k/I) \quad (17)$$

The graphs of FIGS. 6 to 9 showing the area dependency or the current dependency are valid when the contact member and the underlayer are made of a specific material. The same graphs are valid also when another material is used for those members except that the inclination and segments in the graph are different from those in the graphs of FIGS. 6 to 9.

A method of measuring resistance R ($\Omega$) of the contact member will be described.

The contact member is pressed against the photoreceptor layer under actual conditions (in this case, the contact area is S (cm$^2$)). The photoreceptor drum is rotated and moved under actual conditions, and the contact member is rotated, fixed and moved under actual conditions. The voltage Va is applied to the contact member. In a case where the contact member is a contact transfer member, measurement is made in state that a transferred-image recording media, such as a recording paper, is not see between the photoreceptor layer and the contact member. Under this condition, a current I ($\mu$A) flowing into the photoreceptor layer is measured.

Figure 10:
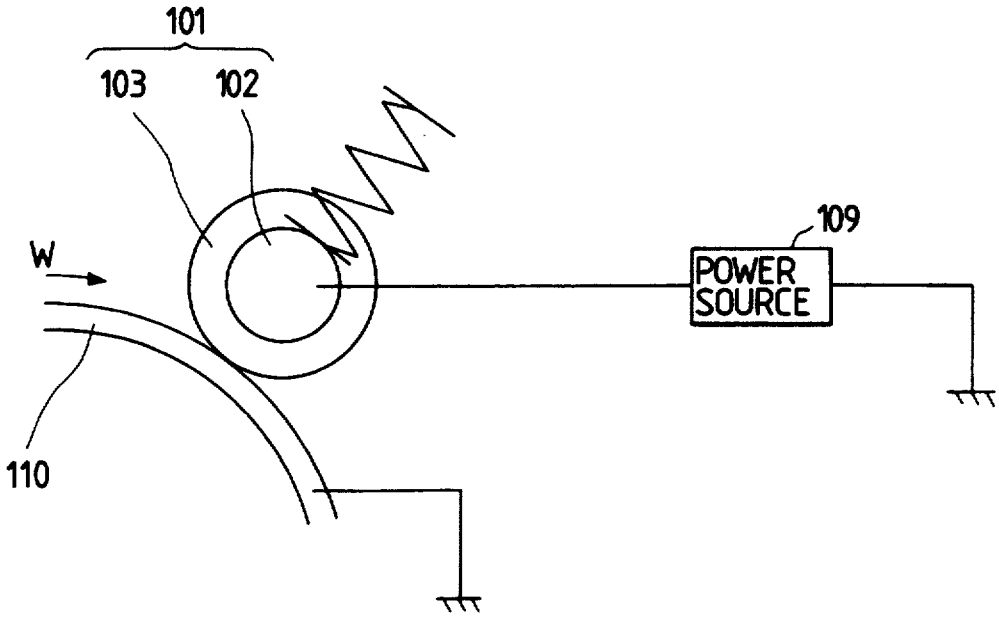
FIG. 10 is a schematic diagram showing a method of measuring resistance of a contact member according to the present invention.
Figure 11A:
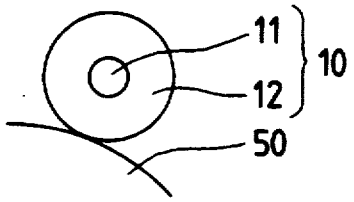
FIG. 11(*a*) to 11(*h*) are cross sectional views schematically illustrating charging members forming contact charging devices according to the present invention.
Figure 11B:
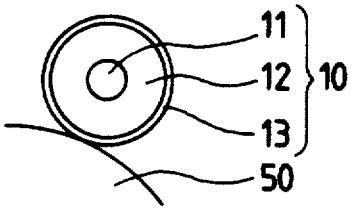
Figure 11C:
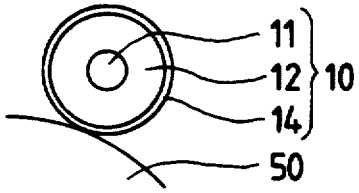
Figure 11D:
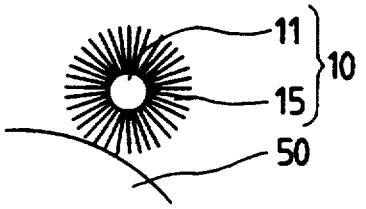
Figure 11E:
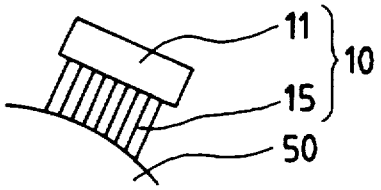
Figure 11F:
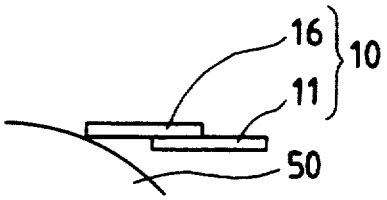
Figure 11G:
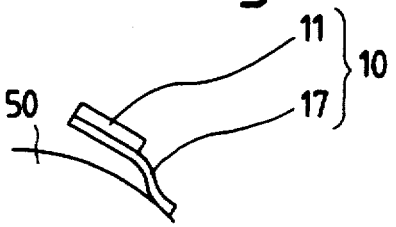
Figure 11H:
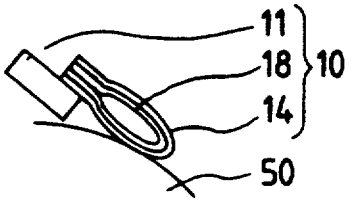
Figure 12A:
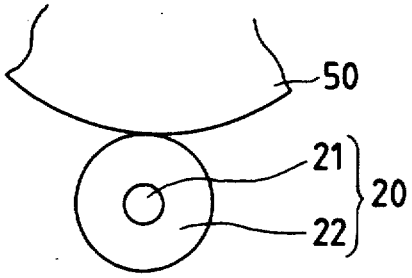
FIGS. 12(*a*) to 12(*d*) are cross sectional views schematically illustrating transfer members forming contact transfer devices according to the present invention.
Figure 12C:
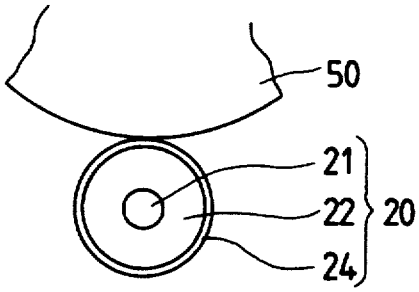
Figure 12B:
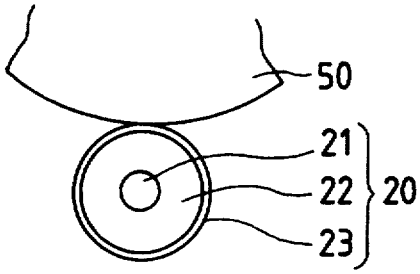
Figure 12D:
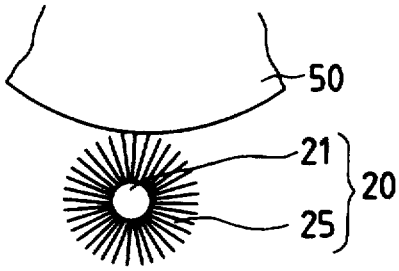

FIG. 10 is a schematic diagram showing a method of measuring resistance of a contact member according to the present invention. In this instance of the embodiment, an object to be measured is a contact member 101 as a one-layer roller.

A metal electrode 110 is used in place of the photoreceptor drum. The contact member 101 is pressed against the metal electrode 110 under actual conditions. The metal electrode 110 is rotated in the direction of an arrow W under actual conditions. The contact member 101 is rotated, fixed, and moved under actual conditions (in the case of FIG. 10, it rotates following the rotation of the metal electrode 110). Under this condition, a power source 109, which is connected between the conductive base member 102 of the contact member 101 and the metal electrode 110, is operated to feed current I (μA) to the member-electrode circuit. A resistance value is calculated using the voltage applied at this time.

The resistance thus measured is defined as a resistance R (Ω) of the contact member.

The method of measuring the breakdown voltage Vt of the underlayer and the resistance Rp thereof will be described.

A test piece used was a drum body having only an underlayer layered thereover, not having the photoreceptor layer. The drum, serving as the base layer, was made of conductive material, such as metal. A member of a volume resistivity at least lower than a tenth part of that of the underlayer is pressed against the test piece so as to have an area of S ($cm^2$). Voltage is applied between the low resistance member and the conductive layer of the photoreceptor drum. After the application of the voltage continues for a preset period of time, the voltage is increased. The voltage is measured when the underlayer is dielectrically broken down.

Needless to say, when $|Vt| > |Va|$, the dielectric breakdown never takes place in the underlayer. A resistance of the underlayer when current $j \times S/s$ (μA) is fed to the area S ($cm^2$) is Rp (Ω) where j (μA) is the current allowed to flow into the area s ($cm^2$) of the underlayer.

If the values of R, Rp, Va, Vt, I, i, j, k, S, s, α, β, and γ thus obtained satisfy the formula (8), (13) or (17), even if the photoreceptor drum is marred by pinholes, remarkable deterioration of image quality and the damage of the members can be prevented.

The same thing is true for a case where the member to be charged and the contact member are supported while being spaced with a minute gap therebetween. The reason for this follows. Since the resistance R is the resistance measured by the method shown in FIG. 10, the resistance R reflects a state of the contact of the photoreceptor layer and the contact member. In this case, the contact area S does not exist since the member to be charged is not in contact with the contact member. Thence, the resistance of the contact member measured when current I (μA) is fed to the contact member in actual use conditions in a state that the member to be charged is substituted by the metal electrode is defined as resistance R. In this instance, the term indicative of the area dependency is 0 (zero) Accordingly, log (S/s) in the formulae (8), (13) and (17) is 0.

In a case where the member to be charged has no underlayer and the photoreceptor layer is directly layered on the conductive layer, a defect of the photoreceptor layer, if passing therethrough, is the pinhole Therefore, only the case (2) for the defective drum is valid for the photoreceptor drum not having the underlayer. In other words, satisfaction of the inequality (17) suffices for that drum.

The application of the invention for an actual image forming apparatus based on the electrophotography system will be described.

FIG. 11 shows cross sectional views schematically illustrating charging members forming contact charging devices according to the present invention. In FIG. 11, a charging member 10 is in contact with a member to be charged 50, and like portions are designated by like reference numerals.

In FIG. 11(*a*), the charging member 10 takes the form of a roller. A conductive elastic-layer 12 is layered on a conductive base member 11. The conductive base member 11 is made of any of metal, alloy, carbon dispersed resin, metal powder dispersed resin, and the like. The metal may be any of iron, aluminum, stainless, brass and the like. The conductive elastic-layer 12 is made mainly of a material selected from among those materials of a material group a) to be given later and a material selected from among those of material groups b)-1 to b)-4.

In FIG. 11(*b*), the charging member 10 also takes the form of a roller. A conductive elastic-layer 12 is layered on a conductive base member 11. A surface layer 13 is layered over the conductive elastic-layer 12. The conductive base member 11 is made of any of metal, alloy, carbon dispersed resin, metal powder dispersed resin, and the like. The metal may be any of iron, aluminum, stainless, brass and the like. The conductive elastic-layer 12 is made mainly of a material selected from among those material of the group a) and a material selected from among those materials of the groups b)-1 to b)-4. The surface layer 13 is made mainly of a material from among the those materials of material groups c)-1 to c)-3.

In FIG. 11(*c*), the charging member 10 also takes the form of a roller. A conductive elastic-layer 12 is layered on a conductive base member 11. A resistive layer 14 is layered over the conductive elastic-layer 12. The conductive base member 11 is made of any of metal, alloy, carbon dispersed resin, metal powder dispersed resin, and the like. The metal may be any of iron, aluminum, stainless, brass and the like. The conductive elastic-layer 12 is made mainly of a material selected from among the materials group a) and a material selected from among those of the groups b)-1 to b)-4. The resistive layer 14 is made mainly of a material selected from the materials of the group a), and materials from among those the groups c)-1 to c)-3.

The conductive elastic-layer is of the solid type or the foamed type. When it is of the foamed type, cell diameters of cells in the base region of the layer maybe larger than the cell diameters in the surface region. A solid skin layer may be provided on the surface of the foamed layer. The surface layer protects the conductive elastic-layer, and prevents low-molecular weight compositions, nonreactive compositions, additive, and the like from oozing out of the conductive elastic-layer. In a case where the charging member of the roller type is used, the peripheral speed of the photoreceptor drum may be equal to or different form that of the roller.

The charging member 10 shown in FIG. 11(*d*) takes the form of a brush roller. A brush 15 is connected or bonded onto a conductive base member 11. The conductive base member 11 is made of any of metal, alloy, carbon dispersed resin, metal powder dispersed resin, and the like. The metal may be any of iron, aluminum, stainless, brass and the like. The brush 15 is made mainly of a material selected from the materials of the group a) and materials selected from those of the groups b)-1 to b)-4 and c)-1 to c)-3. In use, those materials are formed into fibers.

The charging member 10 shown in FIG. 11(*e*) takes the form of a deck brush. A brush 15 is connected or bonded onto a conductive base member 11. The conductive base member 11 is made of any of metal, alloy, carbon dispersed resin, metal powder dispersed resin, and the like. The metal may be any of iron, aluminum, stainless, brass and the like. The brush 15 is made mainly of a material selected from the materials of the group a) and materials selected from those of the groups b)-1 to b)-4 and c)-1 to c)-3. In use, those materials are formed into fibers.

The charging member 10 shown in FIG. 11(*f*) takes the form of a blade. A conductive elastic-layer 16 is connected or bonded onto a conductive base member 11. The conductive base member 11 is made of any of metal, alloy, carbon dispersed resin, metal powder dispersed resin, and the like. The metal may be any of iron, aluminum, stainless, brass and the like. The conductive elastic-layer 16 is made mainly of a material selected from the materials of the group a) and materials selected from those of the groups b)-1 to b)-4 and c)-1 to c)-3. In use, those materials are relatively rigid and shaped into a plate.

The charging member 10 shown in FIG. 11(*g*) takes the form of a film. A conductive film 17 is connected or bonded onto a conductive base member 11. The conductive base member 11 is made of any of metal, alloy, carbon dispersed resin, metal powder dispersed resin, and the like. The metal may be any of iron, aluminum, stainless, brass and the like. The conductive film 17 is made mainly of a material selected from the materials of the group a) and materials selected from those of the groups b)-1 to b)-4 and c)-1 to c)-3. In use, those materials are flexible and shaped into a plate.

The charging member 10 shown in FIG. 11(*h*) takes also the form of a film. A sheet-like means consisting of a resistive layer 14 layered on a conductive film 18 is folded back not forming a crease. The mated part of the sheet-like means is connected or bonded to a conductive base member 11. The conductive base member 11 is made of any of metal, alloy, carbon dispersed resin, metal powder dispersed resin, and the like. The metal may be any of iron, aluminum, stainless, brass and the like. The conductive film 18 is made mainly of a material selected from the materials of the group a) and materials selected from those of the groups b)-1 to b)-4 and c)-1 to c)-3. In use, those materials are shaped into a tear drop. The resistive layer 14 is made mainly of a material selected from those of the group a), and a material from among those of the groups c)-1 to c)-3.

For the charging member, it is required that its resistance value R measured by the method shown in FIG. 10 satisfies one of the formulae (8), (13) and (17). The structure of the charging member is not limited to those illustrated in FIGS. 11(*a*) to 11(*h*), and the materials of it are not limited to those materials stated referring to those figures. The voltage applied to the charging member may be DC voltage (DC current) or voltage formed by superposing AC voltage on DC voltage.

The study by the inventors showed that when the DC voltage is applied to the charging member, a correlation exists among the resistance value R of the charging member that is measured by the method shown in FIG. 10, the applied voltage Va, and the charged potential Vs of the member to be charged. More specifically, when the resistance R of the charging member is approximately $5\times10^7$ (Ω) or more, the voltage Va to gain $Vs=-600$ (V) is $Va\leqq-1.17$ (kV). Further, when the resistance R increases, the absolute value of the voltage Va exponentially increases. If the voltage Va to gain $Vs=-600$ (V) is $Va\geqq-2.0$ (kV), $R\leqq3\times10^8$ (Ω). Therefore, the resistance R of the charging member must be $3\times10^8$ (Ω), preferably $5\times10^7$ (Ω) or less.

The application of the invention for a transfer member of the contact transfer device will be described referring to FIG. 12. In the figure, a transfer member 20 is in contact with a member to be charged 50, and like portions 5 are designated by like reference numerals.

In the transfer member 20 shown in FIG. 12(*a*), which takes the form of a roller, a conductive elastic-layer 22 is layered On a conductive base member 21. The conductive base member 21 is made of any of metal, alloy, carbon dispersed resin, metal powder dispersed resin, and the like. The metal may be any of iron, aluminum, stainless, brass and the like. The conductive elastic-layer 22 is made mainly of a material selected from among those materials of the material group a) and a material selected from among those of the material groups b)-1 to b)-4.

In the transfer member 20 shown in FIG. 12(*b*), which also takes the form of a roller, a conductive elastic-layer 22 is layered on a conductive base member 21. A surface layer 23 is further layered on the conductive elastic-layer 22. The conductive base member 21 is made of any of metal, alloy, carbon dispersed resin, metal powder dispersed resin, and the like. The metal may be any of iron, aluminum, stainless, brass and the like. The conductive elastic-layer 22 is made mainly of a material selected from among those materials of the material group a) and a material selected from among those of the material groups b)-1 to b)-4. The surface layer 23 is made of a material selected from those materials in the groups c)-1 to c)-3.

In the transfer member 20 shown in FIG. 12(*c*), which also takes the form of a roller, a conductive elastic-layer 22 is layered on a conductive base member 21. A resistive layer 24 is further layered on the conductive elastic-layer 22. The conductive base member 21 is made of any of metal, alloy, carbon dispersed resin, metal powder dispersed resin, and the like. The metal may be any of iron, aluminum, stainless, brass and the like. The conductive elastic-layer 22 is made mainly of a material selected from among those materials of the material group a) and a material selected from among those of the groups b)-1 to b)-4. The resistive layer 24 is made mainly of a material selected from among those materials of the material group a) and a material selected from those materials in the groups c)-1 to c)-3.

In the transfer member 20 shown in FIG. 12(*d*), which takes the form of a brush roller, a brush 25 is connected or bonded to a conductive base member 21. The conductive base member 21 is made of any of metal, alloy, carbon dispersed resin, metal powder dispersed resin, and the like. The metal may be any of iron, aluminum, stainless, brass and the like. The brush 25 is made mainly of a material selected from among those materials of the material group a), a material selected from among those of the groups b)-1 to b)-4, and a material selected from those materials in the groups c)-1 to c)-3.

For the transfer member, it is required that its resistance value R measured by the method shown in FIG. 10 satisfies one of the formulae (8), (13) and (17). The structure of the charging member is not limited to those illustrated in FIGS. 12(*a*) to 12(*d*), and the materials of it are not limited to those materials stated referring to those figures.

<MATERIAL GROUPS> a) Carbon black (e.g., furnace black and acetylene black), metal oxide powder (e.g., ITO powder and $SnO_2$ powder), metal, alloy powder (e.g., Ag powder and Al powder), salt (e.g., quaternary ammonium salt and perchlorate), conductive resin (e.g., polyacetylene and polypyrole).

b)-1 Natural rubber.

b)-2 Any or blend of the following synthetic rubber: silicone rubber, fluorine rubber, phlorosilicone rubber, urethane rubber, acrylic rubber, hydron rubber, butadiene rubber, styrene butadiene rubber, nitrile butadiene rubber, isoprene rubber, chloropyrene rubber, isobutylene-isoprene rubber, ethylene-propylene rubber, chlorosulfonated polyethylene rubber, thiokol, and the like.

b)-3 Elastomeric material containing styrol resin, vinyl chloride, polyurethane resin, polyethylene, methacrylate resin, and the like.

b)-4 Soft rubber, such as polyurethane foam, polystyrene foam, polyethylene foam, elastomeric foam, rubber foam, and the like.

c)-1 Any, copolymer, or mixture of the following thermoplastic resin: acrylic resin, such as polyacrylate and polymethacrylate, styrene resin such as polystyrene and poly-1-methylstyrene, butyral resin, polyvinyl chloride, polyvinyl fluoride, polyvinylidene fluoride, polyester resin, polycarbonate resin, cellulose resin, polyarylic resin, polyethylene resin, nylon resin.

c)-2 Any, copolymer, or mixture of the following water-soluble resin: polyvinyl alcohol, polyallyl alcohol, polyvinyl pyrrolidine, polyvinyl amine, polyacrylic amine, polyvinyl acrylic acid, polyvinyl methacrylic acid, polyvinyl sulfuric acid, poly-lactic acid, casein, hydroxyl propyl cellulose, starch, gum arabic, polyglutamine acid, polyaspartic acid, nylon resin, and the like.

c)-3 Thermosetting resin, such as epoxy resin, silicone resin, urethane resin, melamine resin, alkyd resin, polyimide resin, polyamide resin, fluoroplastics, or the like.

Figure 13A:
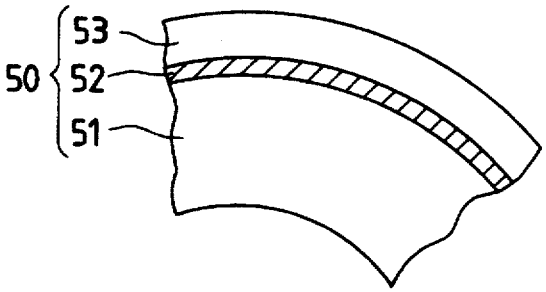
FIG. 13(*a*) and 13(*b*) are cross sectional views schematically showing members to be charged according to the present invention.
Figure 13B:
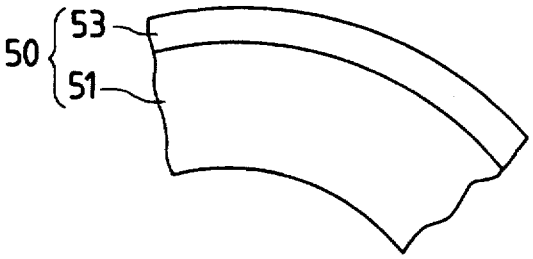

FIG. 13 schematically shows cross sectional views of member to be charged according to the present invention.

A member to be charged 50 shown in FIG. 13(*a*) has a three-layer structure consisting of a conductive base member 51, an underlayer 52, and a dielectric layer 53 as a photoreceptor layer. A member to be charged 50 shown in FIG. 13(*b*) has a two-layer structure in which a dielectric layer 53 is directly layered on the surface of a conductive base member 51, not using the underlayer 52 to be interlayered therebetween. The present invention is applicable for a variety of member to be charged. The conductive base member 51 is made of any of metal, alloy, carbon dispersed resin, metal powder dispersed resin, and the like. The metal may be any of iron, aluminum, stainless, brass and the like.

The underlayer 52 may be a metal oxide film made of any of anodized aluminum ($Al_2O_3$), silicon oxide, boehmite (AlO(OH)), silicon nitride, silicon carbide, and the like, or mainly of a material selected from among those materials of the group a), and a material selected from among those of the groups c)-1 to c)-3.

The dielectric layer 53 is a photoreceptor layer containing an organic or inorganic photoconductive material or made of a material exhibiting electrical insulation property, which is selected from those materials of the groups c)-1 to c)-3. One photoreceptor layer consists of two layers, a charge generating layer (CGL) and a charge transfer layer (CTL). It is of a called function separation type. Another photoreceptor layer consists of a single layer in which a charge generating material (CGM) and a charge transfer material (CTM) are dispersed and compatibilized therein. A protecting layer, if necessary, is layered thereover.

It is evident that the structure of the member to be charged is not limited to the structures illustrated in FIG. 13, and the materials constituting the member to be charged are not limited to those referred to above.

An image forming apparatus incorporating a contact charging device according to the present invention will be described.

Figure 14:
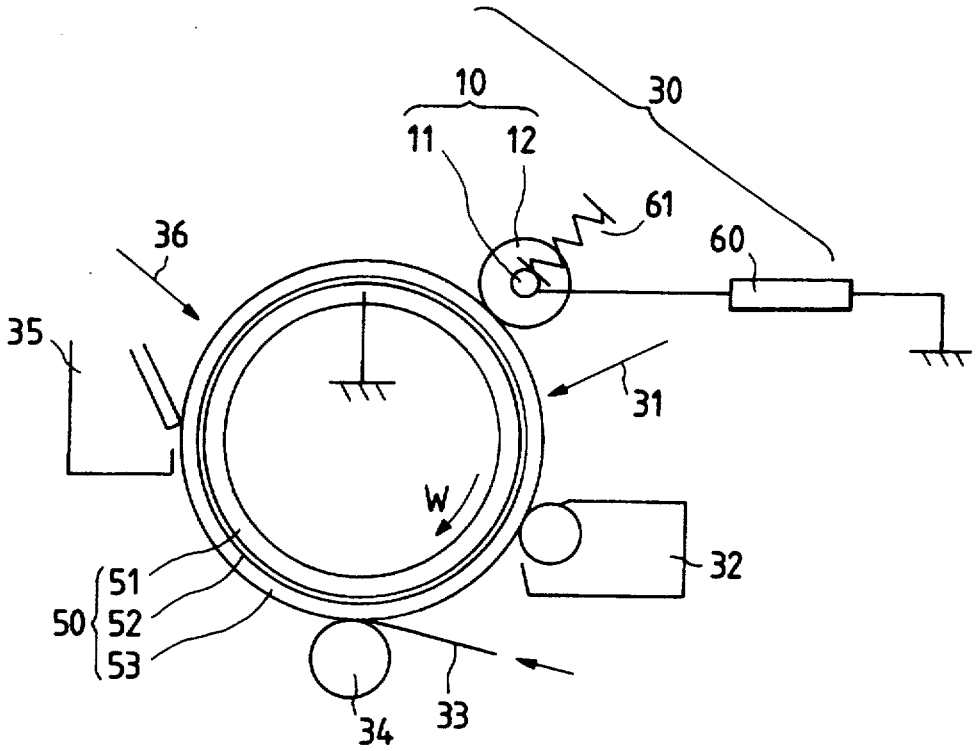
FIG. 14 is a schematic view showing an image forming apparatus incorporating a contact charging device according to the present invention.

An image forming apparatus schematically shown in FIG. 14 uses a charging member as shown in FIG. 11(*a*) and a member to be charged as shown in FIG. 13(*a*). In this embodiment, the charging member is constructed so that its resistance R measured by the method shown in FIG. 10 satisfies any of the formulae (8), (13) and (17).

A member to be charged 50 consists of a grounded, tubular conductive base member 51, an underlayer 52 layered thereon, and a dielectric layer 53 as a photoreceptor layer layered on the underlayer 52. In response to an image formation start signal, the member to be charged 50 starts to rotate at a preset speed in the direction of an arrow W under drive of a drive means, not shown. At this time, a roller 12 of a contact charging device 30 turns following the rotation of the member to be charged 50. During the rotation of those components, a spark takes place in a gap, which is continuously formed therebetween, thereby charging the surface of the member to be charged 50 to a predetermined potential (e.g., −600 (V)).

In the contact charging device 30, a power source 60 applies a voltage to the conductive base member 11 of the charging member 10, and a pressing means 61 presses the roller 12 against the member to be charged 50.

The voltage applied to conductive base member 11 to charge the member to be charged 50 to a predetermined potential may be DC voltage (DC current) or voltage formed by superposing AC voltage on DC voltage. The charging polarity is determined in accordance with the characteristics of the used photoreceptor layer.

Light 31 emitted from a latent image forming means, not shown, forms a latent image, which corresponds to an image on an original document, on the member to be charged 50. Toner supplied from a developing means 32 is electrically attracted onto the latent image on the member to be charged 50, so that the latent image is transformed into a toner image. The toner image on the member to be charged 50 is transferred onto a transferred-image recording media 33 moving in the direction of an arrow by means of a transfer means 34. The transferred image is fuzed and fixed on the transferred-image recording media 33 by a fixing means, not shown.

Toner left on the member to be charged 50 after the transfer step is removed by a cleaning means 35, and if necessary, is exposed to discharging light 36 emitted from a light source, not shown, for ensuring removal of residual charge. Afterwards, the member to be charged 50 is charged again to a predetermined potential by the contact charging device 30 in preparation for the subsequent electrophotographic process.

The latent image forming means may be constructed by a known means, such as a laser optical system, LED and LCS.

The developing means 32 may be any of a two-component magnetic brush developing means, a one-component magnetic brush developing means, a one-component jumping developing means, a one-component press-contact developing means, and the like. The toner as develper is particles of 5 to 20 (μm), made of bonding resin, such as polyester resin and styrene acrylic resin, in which coloring material is dispersed. If necessary, surface active agent (dispersion agent), charge control agent, offset resistance agent, filler, fluidity improving agent is externally or internally added to the bonding resin containing coloring agent dispersed therein. The surface active agent is metal soap, polyethylene glycol, or the like. The charge control agent is electron acceptable organic complex, chlorinated polyester, nitrohumic acid, quaternary ammonium salt, pyridinium salt or the like. The offset resistance agent is, for example, polypropylene. The filler is, for example, talc. The fluidity improving agent is $SiO_2$, $TiO_2$, or the like. The toner is uniformly mixed and dispersed within the developing unit, and charged to a predetermined potential. Within the developing unit, it may be mixed with carriers. In the reversal development, the charge polarity of toner is negative in a state that the charge polarity of the member to be charged 50 is negative.

The transfer means 34 may be means for electrostatically transferring the toner image, such as a corona charging means or a contact transfer device. The cleaning means 35 may be a blade cleaning means or a fur brush cleaning means. An LED lamp may be used for the discharging light 36. The discharging light 36 is not essential to the image formation.

In this way, an image is formed on the transferred-image recording media 33.

The resistance value R of the charging member used in this embodiment, which is measured by the method of FIG. 10, satisfies the formula (8), (13) or (17). Therefore, the image formed is free from the black stripes and deterioration of the charging member. High quality images can be reliably produced.

An image forming apparatus incorporating a contact transfer device according to the present invention will be described.

Figure 15:
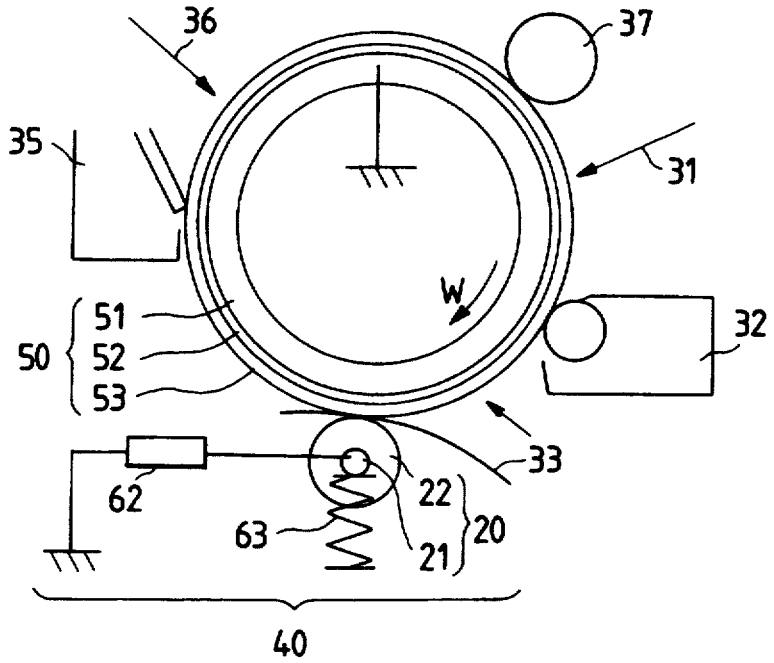
FIG. 15 is a schematic view showing an image forming apparatus incorporating a contact transfer device according to the present invention.
Figure 16A:
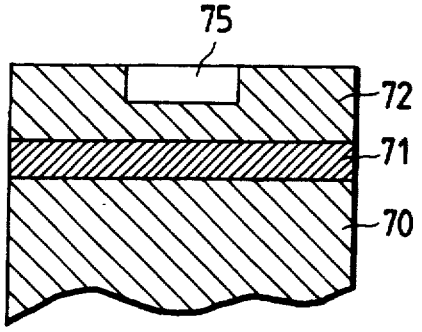
FIGS. 16(*a*) to 16(*d*) are diagrams showing models of typical defects frequently found in a photoreceptor drum.
Figure 16B:
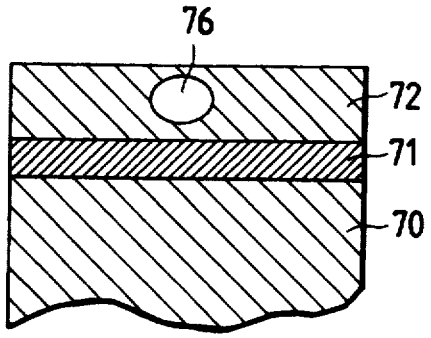
Figure 16C:
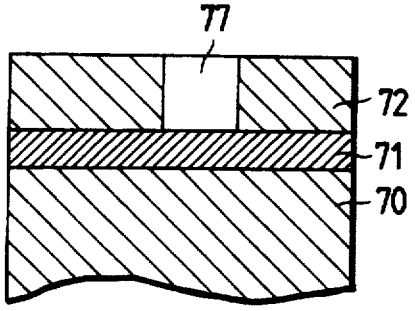
Figure 16D:
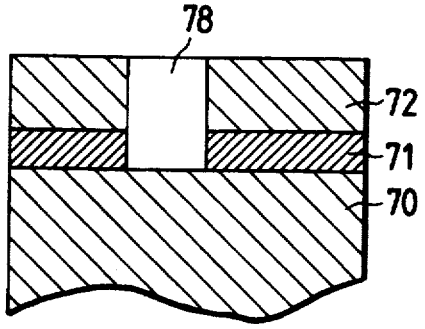

An image forming apparatus schematically shown in FIG. 15 uses a transfer member as shown in FIG. 12(*a*) and a member to be charged as shown in FIG. 13(*a*). In this embodiment, the transfer member is constructed so that its resistance R measured by the method shown in FIG. 10 satisfies any of the formulae (8), (13) and (17).

A member to be charged 50 consists of a grounded, tubular conductive base member 51, an underlayer 52 layered thereon, and a dielectric layer 53 as a photoreceptor layer layered on the underlayer 52. In response to an image formation start signal, the member to be charged 50 starts to rotate at a preset speed in the direction of an arrow W under drive of a drive means, not shown. The surface of the member to be charged 50 is charged to a predetermined potential by means of a charging means 37. Light 31 emitted from a latent image forming means, not shown, forms a latent image, which corresponds to an image on an original document, on the member to be charged 50. Toner supplied from a developing means 32 develops the latent image on the member to be charged 50 into a toner image. The toner image on the member to be charged 50 is transferred onto a transferred-image recording media 33 moving in the direction of an arrow by means of a contact transfer device 40. The transferred image is fuzed and fixed on the transferred-image recording media 33 by a fixing means, not shown.

In the contact transfer device 40, a voltage opposite in polarity to the charge polarity of the toner, is applied from a power source 62 to the conductive base member 21. A pressing means 63 presses a conductive elastic-layer 22 against the member to be charged 50. The transfer member 20 rotates with the rotation of the member to be charged 50.

Toner left on the member to be charged 50 after the transfer step is removed by a cleaning means 35, and if necessary, is exposed to discharging light 36 emitted from a light source, not shown, for ensuring a removal of residual charge. Afterwards, the member to be charged 50 is charged again to a predetermined potential by the charging means 37 in preparation for the subsequent electrophotographic process.

The charging means may be a corona charging means or a contact charging device.

During a period of time till the toner image on the member to be charged 50 reaches a transfer position, the transfer member may be cleaned by changing the power source to another by means of a switch, not shown. In this case, the polarity of the cleaning voltage is the same as the charge polarity of the toner.

The transfer member 20 may be forcibly rotated by means of a gear mechanism, not the rotation of the member to be charged 50.

In this way, an image is formed on the transferred-image recording media 33.

The resistance value R of the transfer member used in this embodiment, which is measured by the method of FIG. 10, satisfies the formula (8), (13) or (17). Therefore, the image formed is free from the black stripes and deterioration of the transfer member. High quality images can be reliably produced.

Specific examples of the present invention will be described in detail.

EXAMPLE 1

A charging member of a contact charging device was members A to G of 22.5 (cm) in effective length, which are listed below. The member to be chargeds were each a tubular member to be charged of 3 (cmϕ) consisting of a tubular conductive base member of aluminum, an anodized-aluminum underlayer of 8 (μm) thick, and a dielectric layer as a photoreceptor layer of 20 (μm) thick of the function separation/negative charging type.

A) Member A

The member A is a roller with a conductive elastic layer of an urethane foam with carbon black internally added thereto. The roller is specified by volume resistivity of $10^7$ (Ωcm), Asker C hardness of 30 (°), cell diameter of 200 (μm), and thickness of 5 (mm).

B) Member B

The member B is a roller with a conductive elastic layer of an open-cell type urethane foam with carbon black internally added thereto. The roller is specified by volume resistivity of $10^8$ (Ωcm), Asker C hardness of 26 (°), cell diameter of 10 (μm) by the bubble point method, and thickness of 5 (mm).

C) Member C

The member C is a roller with a conductive elastic layer of an urethane rubber with perchlorate internally added thereto. The roller is specified by volume resistivity of $9 \times 10^6$ (Ωcm), Asker C hardness of 60 (°), and thickness of 5 (mm).

D) Member D

The member D is a roller with a conductive elastic layer of a silicon foam with carbon black internally added thereto (volume resistivity: $10^5$ (Ωcm)). A nylon heat shrinkage tube with perchlorate internally added thereto (volume resistivity: $5 \times 10^9$ (Ωcm) and thickness: 50 (μm)) is fit to the roller with the conductive elastic layer layered thereon (Asker C hardness of 60 (°), and thickness of 5 (mm).

E) Member E

The member E is a roller with a conductive elastic layer of a silicon foam with carbon black added thereto (volume resistivity: $10^5$ (Ωcm)). A nylon heat shrinkage tube with carbon black internally added thereto (volume resistivity: $5\times10^{10}$ (Ωcm)) is fit to the roller with the conductive elastic layer layered thereon (Asker C hardness of 60 (°), and thickness of 5 (mm).

F) Member F

The member F is a deck brush using regenerated cellulosic fibers with carbon black internally added thereto (600 (D)/100 (F), 100000 (F/inch$^2$), volume resistivity: $10^8$ (Ωcm), brush length: 5 (mm), and brush width: 8 (mm)).

G) Member G

The member G is a polyethylene film (volume resistivity: $10^9$ (Ωcm) and thickness: 40 (μm)), folded in two (as shown in FIG. 11(*h*)) and backed with an aluminum layer, which contains carbon black internally added thereto.

To measure the volume resistivity, an object to be measured was cut out into a block or sheet as a test piece, and was measured by a high resistivity measuring meter (for example, HIRESTA IP (manufactured by Mitsubishi Yuka Co., Ltd.) in a state that 100 V is applied to the test piece for one minute. The measurement was carried out in the NN environment (20 (°C.) and 50 (%RH)). Otherwise noticed, the subsequent measurements will be carried out in the NN environment.

Defects were intentionally formed in members to be charged. Each of the defect marred members to be charged and each of the members A to G were set to the image forming apparatus shown in FIG. 14. Actually, images were formed and states of images were inspected. Every time the member was replaced with another, the member to be charged was replaced with a new one.

Defects of approximately 0.3 (mmϕ) or more can be inspected visually. Accordingly, the members to be charged suffering from such large defects can be removed before used. Keeping this in mind, the size of the defect to be formed in the member to be charged was set to 0.3 (mmϕ) (area was set at $7\times10^{-4}$ (cm$^2$)) as the critical size by the visual inspection. Two types of defects were formed: one is a called pinhole (defect of the type passing through the underlayer as well as the photoreceptor layer) and the other is a defect of the type destroying only the photoreceptor layer, not reaching the underlayer).

Before an experiment is conducted, each charging member was set to the image forming apparatus shown in FIG. 14. Voltage Va and current I, necessary for charging a member to be charged to −600 (V), were measured. The peripheral speed of the member to be charged was 3 (cm/sec). The results of the measurement were Va = −1.16 (kV) and I = −6 (μA).

The resistance R of the member was measured by the resistance measuring method shown in FIG. 10. The current fed was −6 (μA), and the metal electrode 110 was a tubular electrode of 3 (cmϕ) in diameter and rotated at the peripheral speed of 3 (cm/sec). For the members A to E, the load of 1 (kg) was applied to the member to press it against the metal electrode 110. For the members F and G, a space of 3 (mm) was kept between the conductive base member and the metal electrode. The results are shown in Table 1.

Va = −1.16 (kV) and the restricted current value of the power source was −20 (μA). The experiment results are also shown in Table 1.

TABLE 1

| Member | R (Ω) | Defect | Pinhole |
|---|---|---|---|
| A | $2\times10^6$ | Black stripe | Black stripe |
| B | $3\times10^7$ | Black stripe | Black stripe |
| C | $5\times10^6$ | Black dot | Black dot |
| D | $2\times10^7$ | Black dot | Black dot |
| E | $1\times10^7$ | Black stripe | Black stripe |
| F | $6\times10^6$ | Black dot | Black dot |
| G | $6\times10^6$ | Black dot | Black dot |

As seen from Table 1, states (black stripes or black dots) of images formed by using the photoreceptor layers marred by defects and pinholes have no connection with the resistance values R of the members. In the case of the images containing only black dots, it can be considered that a measure has been taken to solve the pinhole problems.

From this, it is seen that the conventional measure of increasing the resistance of the member or the volume resistivity of the member, and the measure of constructing the member in the multilayered structure fail to solve the pinhole problems.

To confirm the effects of the invention, the following measurements were conducted. A test piece was constructed in which only an underlayer of an anodized aluminum layer of 8 (μm) thick was formed on a tubular conductive base member of aluminum. A breakdown voltage Vt of the underlayer and a resistance value Rp of the underlayer were measured. An area S of an electrode brought into contact with the surface of the underlayer was 6.57 (cm$^2$) (corresponding to the nip width 3 (mm)). The measurement results were: Vt (breakdown voltage) = −300 V and Rp (resistance) = $2\times10^6$ (Ω). Accordingly, $i=-300/(2\times10^6)=-150\times10^{-6}=-150$ (μA).

The area dependency of resistance of the underlayer was measured. The electrode area was set in four levels: 675 (cm$^2$), 1 (cm$^2$), 0.5 (cm$^2$), and 0.1 (cm$^2$). The current density was $\{-300/(2\times10^6)\}/6.75=-22.2\times10^{-6}-22.2$ (μA/cm$^2$). Measured values, as shown in FIG. 3, were plotted on a graph of which the abscissa represents a logarithmic value of the area and the ordinate, a logarithmic value of resistance. Connection of the measured values formed a straight line inclined at −1. Therefore $\alpha=1$.

Then, a pinhole of 0.3 (mmϕ) was formed in a member to be charged. A tolerable current value within which no further enlargement of the pinhole or no further deterioration of the member progresses, was measured.

The current was gradually increased while observing states of the pinhole and the member. The current at which the pinhole starts to grow or the current at which the deterioration of the member starts was measured. The member used was the member A. A constant current was fed for 30 minutes. As a result, no enlargement of the pinhole and no deterioration of the member were observed till the current is increased up to −3 (μA). Accordingly, k=31 3(μA).

Since the breakdown voltage Vt of the underlayer is −300 (V), $|Vt|\leqq|Va|$. To take a measure for the pinhole problem, either of the formula (8) or (17) must be satisfied. To take a measure to prevent the underlayer from being broken down, the current flowing into the area s (cm$^2$) of the underlayer is $|-22.2\times7\times10^{-4}|=|-0.02\ (\mu A)|<|-3\ (\mu A)|$. This current cannot enlarge the defect of the photoreceptor layer.

The area dependency $1-\beta$ and the current dependency $\gamma$ of the resistance of the members A to G were measured.

In measuring the area dependency of the member resistance, the electrode area was set in four levels: 6.75 ($cm^2$), 1 ($cm^2$), 0.5 ($cm^2$), and 0.1 ($cm^2$). The current density was set in two levels: $\{-300/(2633\ 10^6)\}/6.75=-22.2\times10^{-6}$ [$-22.2$ ($\mu A/cm^2$)] and $\{-3\times10^{-6}/7\times10^{-4})=-4.3\times10^{-3}$ [$-4.3$ ($mA/cm^2$)]. For the respective current densities, measured values were plotted on a graph of which the abscissa represents a logarithmic value of the area and the ordinate represents a logarithmic value of resistance, as shown in FIG. 3. An inclination of a straight line formed by connecting the measured values, and hence $\beta$ were obtained.

In measuring the current dependency of the member resistance, the electrode area was set at 6.75 ($cm^2$), and the current density was set in four levels: $-0.1$ ($\mu A$), $-1$ ($\mu A$), $-6$ ($\mu A$), and $-100$ ($\mu A$). The measured values were plotted on a graph of which the abscissa represents a logarithmic value of the current and the ordinate represents a logarithmic value of resistance, as shown in FIG. 5. An inclination of a straight line formed by connecting the measured values, and then $\gamma$ were obtained.

$\beta$ and $\gamma$ values of the members A to G are shown in Table 2. The current density 1 is $-22.2$ ($\mu A/cm^2$), and The current density 2 is $-4.3$ ($mA/cm^2$). The resistance values of those members are also shown in Table 2.

TABLE 2

| Member | R (Ω) | $\beta$ Current density 1 | $\beta$ Current density 2 | $\gamma$ |
|---|---|---|---|---|
| A | $2\times10^6$ | 0.65 | 0.63 | 0.55 |
| B | $3\times10^7$ | 0.78 | 0.74 | 0.66 |
| C | $5\times10^6$ | 0.96 | 0.96 | 0.02 |
| D | $2\times10^7$ | 1.00 | 1.00 | 0.24 |
| E | $1\times10^7$ | 0.80 | 0.77 | 0.70 |
| F | $6\times10^6$ | 0.90 | 0.90 | 0.42 |
| G | $6\times10^6$ | 0.95 | 0.95 | 0.20 |

Check was made as to whether the formula (8) or (17) is satisfied or not, using the values shown in Table 2, $Va=-1160$ (V), $S/s=9600$, $i/I=25$, $k/I=0.5$, $\alpha=1$, $Vt=-300$ (V), and $Rp=2\times10^6$ (Ω).

The results of the check are shown in Table 3.

TABLE 3

| Member | Log (R) | Formula (8) Satisfied | Formula (8) Right side | Formula (17) Satisfied | Formula (17) Right side |
|---|---|---|---|---|---|
| A | 6.3 | x | 8.9 | x | 8.0 |
| B | 7.5 | x | 8.6 | x | 7.9 |
| C | 6.7 | x | 7.0 | ○ | 4.9 |
| D | 7.3 | ○ | 7.1 | ○ | 5.5 |
| E | 7.0 | x | 8.6 | x | 8.0 |
| F | 6.8 | x | 7.8 | ○ | 6.6 |
| G | 6.8 | x | 7.3 | ○ | 5.6 |

In Table 3, the resistance values R are expressed in terms of logarithmic values. In the columns of the formulae (8) and (17), ○ indicates that the formula is satisfied, and x indicates that the formula is not satisfied. Calculation values of right sides of the formula are also shown.

When comparing Tables 1 and 3, it is seen that in the case of the members in which the defects thereof does not grow into pinholes and the image noise caused by the defects remains black dots, either of the formulae (8) and (17) is satisfied.

In another test, the members C, D, F and G, and a member to be charged not suffering the defects were set to the image forming apparatus shown in FIG. 14, and images were formed on 10,000 sheets of transferred-image recording medium of A4 size. It was confirmed that no images having black stripes were observed.

EXAMPLE 2

The members to be charged used were each a tubular charged member of 3 (cmϕ) consisting of a tubular conductive base member of aluminum, an underlayer of 10 (μm) thick and made of medium resistance nylon, and a dielectric layer as a photoreceptor layer of 20 (μm) thick of the function separation/negative charging type.

As in EXAMPLE 1, defects each of 0.3 (mmϕ) were intentionally formed in members to be charged. Each of the defect marred the member to be charged and each of the members A to G were set to the image forming apparatus shown in FIG. 14. Actually, images were formed and states of images were inspected. Every time the member was replaced with another, the member to be charged was replaced with a new one.

Before an experiment is conducted, each charging member was set to the image forming apparatus shown in FIG. 14. Voltage Va and current I, necessary for charging a member to be charged to $-600$ (V), were measured. The peripheral speed of the charged member was 3 (cm/sec). The results of the measurement were $Va=-1.16$ (kV) and $I=-6$ ($\mu A$).

In the experiment, $Va=-1.16$ (kV) and the restricted current value of the power source was $-20$ ($\mu A$). The experiment results are also shown in Table 4.

A test piece was constructed in which only an underlayer of a medium resistance nylon layer of 10 (μm) thick was formed on a tubular conductive base member of aluminum. A breakdown voltage Vt of the underlayer and a resistance value Rp of the underlayer were measured. An area S of an electrode brought into contact with the surface of the underlayer was 6.57 ($cm^2$) (corresponding to the nip width 3 (mm)). The measurement results were: $Vt=-1000$ V and $Rp=1\times10^7$ ((Ω)). $i=-1000/(1\times10^7)=-100\times10^{-6}=-100$ ($\mu A$).

The area dependency of resistance of the underlayer was measured. The electrode area was set in four levels: 6.75 ($cm^2$), 1 ($cm^2$), 0.5 ($cm^2$), and 0.1 ($cm^2$). The current density was $\{-1000/(1\times10^7)\}/6.75=-14.8\times10^{-6}=-14.8$ ($\mu A/cm^2$). Measured values, as shown in FIG. 3, were plotted on a graph of which the abscissa represents a logarithmic value of the area and the ordinate, a logarithmic value of resistance. Connection of the measured values formed a straight line inclined at $-0.95$. Therefore, $\alpha=0.95$.

Then, a pinhole of 0.3 (mmϕ) was formed in a member to be charged. A tolerable current value within which no further enlargement of the pinhole or no further deterioration of the member progresses, was measured.

The current was gradually increased while observing states of the pinhole and the member. The current at which the pinhole starts to grow or the current at which the deterioration of the member starts was measured.

The member used was the member A. A constant current was fed for 30 minutes. As a result, no enlargement of the pinhole and no deterioration of the member were observed till the current is increased up to $-0.5$ ($\mu$A). Accordingly, $k=-0.5$ ($\mu$A).

Since the breakdown voltage Vt of the underlayer is $-1000$ (V), $|Vt| \leqq |Va|$. To take a measure for the pinhole problem, either of the formula (8) or (17) must be satisfied. To take a measure to prevent the underlayer from being broken down, the current allowed to flow into the area s ($cm^2$) of the underlayer is $|-14.8\times7\times10^{-4}|=|-0.01\ (\mu A)|<|-0.5\ (\mu A)|$. This current value cannot enlarge the defect of the photoreceptor layer.

The area dependency of the members A to G depends little on the current density, as seen from Table 2. Accordingly, the current density 1 in Table 2 was used for the area dependency.

Check was made as to whether the formula (8) or (17) is satisfied or not, using the values $\beta$ and $\gamma$ shown in Table 2, $Va=-1160$ (V), $S/s=9600$, $i/I=16.7$, $k/I=0.083$, $\alpha=0.95$, $Vt=-1000$ (V), and $Rp=1\times10^7$ ($\Omega$).

The results of the check are shown in Table 4.

TABLE 4

| Member | Image | Log (R) | Formula (8) Satisfied | Formula (8) Right side | Formula (17) Satisfied | Formula (17) Right side |
|---|---|---|---|---|---|---|
| A | BS | 6.3 | x | 8.2 | x | 8.3 |
| B | BS | 7.5 | x | 7.8 | x | 8.1 |
| C | BD | 6.7 | ○ | 6.3 | ○ | 5.5 |
| D | BD | 7.3 | ○ | 6.4 | ○ | 6.0 |
| E | BS | 7.0 | x | 7.8 | x | 8.1 |
| F | BS | 6.8 | x | 7.0 | x | 6.9 |
| G | BD | 6.8 | ○ | 6.5 | ○ | 6.1 |

In Table 4, in the "image" column, BS and BD indicate a black stripe and a black dot, respectively. The resistance values R are expressed in terms of logarithmic values. In the columns of the Formulae (8) and (17), ○ indicates that the formula is satisfied, and x indicates that the formula is not satisfied. Calculation values of right sides of the formulae are also shown.

As seen from Table 4, in the case of the members in which the image noise formed by the member remains black dots, either of the formulae (8) and (17) is satisfied. When comparing Tables 3 and 4, it is seen that when the member to be charged is changed to another, the image noise (black stripe and black dot) is changed to another type of image noise if the same member is used.

In another test, the members C, D, and G, and a member to be charged not suffering the defects were set to the image forming apparatus shown in FIG. 14, and images were formed on 10,000 sheets of transferred-image recording medium of A4 size. Any image having the black stripe could not be observed.

EXAMPLE 3

The members C, D, F, and G, which succeed in dealing with the pinhole problems in EXAMPLE 1, were used for the charging members. The same member to be charged as that used in EXAMPLE 1 was used. Check was made as to whether or not the apparatus using those members are capable of dealing with the pinhole problems. Measurement for the check were carried out in environments different from those in EXAMPLE 1; LL environment (10 (°C.) and 15 (%RH)) and HH environment (35 (°C.) and 65 (%RH)).

Before an experiment is conducted, each charging member was set to the image forming apparatus shown in FIG. 14. Voltage Va and current I, necessary for charging a member to be charged to $-600$ (V), were measured in the different environments. The peripheral speed of the member to be charged was 3 (cm/sec). The results of the measurement were $Va=-1.16$ (kV) and $I=-6$ ($\mu$A) even in the different environments.

As in EXAMPLE 1, defects each of 0.3 (mm$\phi$) were intentionally formed in members to be charged. Under the condition that $Va=-1.16$ (kV) and the restricted current of the power source was $-20$ ($\mu$A), images were actually formed and states of images were inspected. Every time the member was replaced with another, the member to be charged was replaced with a new one. The results of the inspection are shown in Table 7.

Then, the breakdown voltage Vt of the underlayer, the resistance Rp of the underlayer, and the area dependency $1-\alpha$ of resistance were measured Further, a pinhole of 0.3 (mm$\phi$) was intentionally formed in a member to be charged. A tolerable current value k within which no further enlargement of the pinhole or no further deterioration of the member progresses, was measured. The results of the measurements in the environments LL and HH, and additionally in the environment NN are shown in Table 5.

TABLE 5

| | LL | NN | HH |
|---|---|---|---|
| Vt (V) | $-400$ | $-300$ | $-250$ |
| Rp ($\Omega$) | $6\times10^6$ | $2\times10^6$ | $9\times10^5$ |
| Vt/Rp ($\mu$A) | $-67$ | $-150$ | $-278$ |
| $\alpha$ | 1 | 1 | 1 |
| k ($\mu$A) | $-3$ | $-3$ | $-3$ |

The results of Table 5 show that the breakdown voltage Vt of the underlayer, and the resistance Rp of the underlayer vary depending on the environments.

Since $|Vt| \leqq |Va|$, to take a measure for the pinhole problem, either of the formula (8) or (17) must be satisfied.

The results of measuring the resistance values R, the area dependency $1-\beta$ of the resistance, and the current dependency $\gamma$ of the resistance of the members C, D, F and G are shown in Table 6. In this table, the $\beta$ values were obtained at the current densities $-9.9$, $-22.2$, $-41.2$ ($\mu A/cm^2$) in the environments LL, NN and HH. The measured values in the environment NN are also shown in Table 6.

TABLE 6

| Member | LL R | LL $\beta$ | LL $\gamma$ | NN R | NN $\beta$ | NN $\gamma$ | HH R | HH $\beta$ | HH $\gamma$ |
|---|---|---|---|---|---|---|---|---|---|
| C | $2\times10^7$ | 0.98 | 0.02 | $5\times10^6$ | 0.96 | 0.02 | $1\times10^6$ | 0.9 | 0.02 |
| D | $6\times10^7$ | 1.0 | 0.24 | $2\times10^7$ | 1.0 | 0.24 | $2\times10^6$ | 1.0 | 0.24 |
| F | $1\times10^7$ | 0.95 | 0.42 | $6\times10^6$ | 0.9 | 0.42 | $3\times10^6$ | 0.85 | 0.42 |
| G | $8\times10^6$ | 1.0 | 0.2 | $6\times10^6$ | 0.95 | 0.2 | $3\times10^6$ | 0.92 | 0.2 |

Table 6 shows that the resistance R of the member, like the resistance Rp of the underlayer, depends on the environments, but the area dependency $1-\beta$ of the resistance and the current dependency $\gamma$ of the member resistance depends little on the environments.

Check was made as to whether the formula (8) or (17) is satisfied or not, using the values shown in Tables 5 and 6, Va = −1160 (V) and S/s = 9600. Table 7 also shows the results of this check.

TABLE 7

| Member | LL | | | NN | | | HH | | |
|---|---|---|---|---|---|---|---|---|---|
| | Image | (8) | (17) | Image | (8) | (17) | Image | (8) | (17) |
| C | BD | ○ 7.2 | ○ 4.8 | BD | x 7.0 | ○ 4.9 | BD | x 7.0 | ○ 5.1 |
| D | BD | ○ 7.3 | ○ 5.5 | BD | ○ 7.1 | ○ 5.5 | BD | ○ 6.9 | ○ 5.5 |
| F | BD | x 7.7 | ○ 6.4 | BD | x 7.8 | ○ 6.6 | BS | x 7.8 | x 6.8 |
| G | BD | x 7.3 | ○ 5.4 | BD | x 7.3 | ○ 5.6 | BD | x 7.2 | ○ 5.7 |

In Table 7, in the "image" column, BS and BD indicate a black stripe and a black dot, respectively. In the columns of the formulae (8) and (17), ○ indicates that the formula is satisfied, and x indicates that the formula is not satisfied. Calculation values of right sides of the formulae are also shown.

As seen from Table 7, when the measuring environment is changed to another environment, one of the members forms a black stripe by the pinhole in the image. It is also seen that also in this case, the black dot is not changed to the black stripe if either of the formulae (8) and (17) is satisfied. As a consequence, the fact that the present invention is valid irrespective of the environments was confirmed.

In another test, the members C, D, and G, and a member to be charged not suffering the defects were set to the image forming apparatus shown in FIG. 14, and images were formed on 10,000 sheets of transferred-image recording of A4 size in a room where temperature and humidity were not adjusted. It is confirmed that any of the images had no black stripe.

EXAMPLE 4

The restricted current value of the power source for applying a voltage to the member is the sum of the current I (μA) necessary for charging the member to be charged to a predetermined potential and the current k (μA) allowed to flow into the pinhole. As in EXAMPLE 1, defects each of 0.3 (mmϕ) were intentionally formed in members to be charged. Actually, images were formed and states of images were inspected. The members C, D, and G were used for the charging members. The same member to be charged as that used in EXAMPLE 1 was used.

Images were formed on 1,000 sheets of transferred-image recording medium of A4 size in the environments LL to HH. The images formed were excellent in quality, not suffering from the black stripes caused by the pinholes.

When synthesizing the above results and the results of EXAMPLE 3, it was seen that if a power source capacity P satisfies the following condition $$P \geqq Va \times (I+k) \times 10^{-6} (W),$$

quality images can be formed.

In another test, the members C, D, and G, and a member to be charged not suffering the defects were set to the image forming apparatus shown in FIG. 14, and images were formed on 10,000 sheets of transferred-image recording of A4 size in a room where temperature and humidity were not adjusted. No black stripes were observed in the images.

EXAMPLE 5

The members C, D, and G were used for the charging members. A photoreceptor layer not having an underlayer was used for the member to be charged. The member to be charged used was a tubular member to be charged of 3 (cmϕ) consisting of a tubular conductive base member of aluminum, and a dielectric layer as a photoreceptor layer of 20 (μm) thick of the function separation/negative charging type. The peripheral speed of the member to be charged was 1.5 (cm/sec), different from those in the examples already described.

Voltage Va and current I, necessary for charging a member to be charged to −600 (V), were measured. The results of the measurement were: Va = −1.16 (kV) and I = −3 (μA).

A pinhole of 0.3 (mmϕ) was intentionally formed in the charging member. A tolerable current value within which no further enlargement of the pinhole or no further deterioration of the member progresses, was measured as in EXAMPLE 1. The current value was −3 (μA).

Defects each of 0.3 (mmϕ) were intentionally formed in members to be charged. Under the condition that Va = −1.16 (kV) and the restricted current of the power source was −6 (μA) using a charging member forming a pinhole of 0.3 (mmϕ), images were actually formed and states of images were inspected. The results were: the members C and D produced good images, but the member E produced the image marred by a black stripe.

In this example, the underlayer is not used. Accordingly, satisfaction of only the inequality (17) suffices for the measure for the pinhole problem. Check was made as to whether or not the inequality (17) is satisfied. The results were: the members C and D satisfied the inequality (17), but the member E did not satisfy the inequality. Also from this fact, it is seen that the black stripe formation can be suppressed if the inequality (17) is satisfied even in the case where the photoreceptor layer not having the underlayer is used.

EXAMPLE 6

The members C and D were used for the charging members. The same member to be charged as that used in EXAMPLE 1 was used. The voltage applied to the charging member was formed by superposing an AC voltage on a DC voltage. The DC voltage was −600 (V), the peak-to-peak voltage of the AC voltage was 1.4 (kV), the frequency of the AC voltage was 0.8 (kHz), and the waveform of the AC voltage was sinusoidal. The remaining specifications were the same as those in EXAMPLE 1.

Before an experiment is conducted, each charging member was set to the image forming apparatus shown in FIG. 14. An experiment of charging the member to be charged was conducted. The results of the measurement were: the member to be charged was charged to −600 (V), and the current flowing at that time was −6 (μA).

As in EXAMPLE 1, defects each of 0.3 (mmϕ) were intentionally formed in members to be charged. Each of the defect marred member to be charged and each of the members C and D were set to the image forming apparatus shown in FIG. 14. Actually, images were formed and states of images were inspected. Every time the member was replaced with another, the member to be charged was replaced with a new one. The results were: the members C and D produced images containing black dots, not black stripes.

The resistance values R of the members C and D are defined by −6 (μA) of the current fed thereto, and Va=(DC voltage)+(effective value of the AC voltage)=−600−495=−1095 (V). Calculation was made to check whether or not the formula (8) or (17) is satisfied, as in EXAMPLE 1. Both the members C and D satisfied the formula (17). Also when Va=(DC voltage)+(effective value of the AC voltage)=−600−1400=−2000 (V), both the members C and D satisfied the formula (17).

In another test, the members C and D and a member to be charged not suffering the defects were set to the image forming apparatus shown in FIG. 14, and images were formed on 10,000 sheets of transferred-image recording medium of A4 size by applying the voltage formed by superposing the AC voltage to the DC voltage to the charging member thereby to charge it. Any image having the black stripe could not be observed.

The fact that even when the voltage formed by superposing the AC voltage to the DC voltage is applied to the charging member, if the condition is set up on the assumption that the sum of the voltage and the effective value or peak value of its voltage is Va, the effects obtained are comparable with those obtained in the case using the DC voltage, was confirmed.

EXAMPLE 7

The charging members for a contact charging device were the members AA to AE constructed such that the surface layers (resistive layers) (described below) are formed on the surfaces of the members A shown in EXAMPLE 1. The peripheral speed of the member to be charged was 3 (cm/sec). Va=−1.16 (kV) and I=−6 (μA) were required for charging the surface to −600 (V).

Member AA: The surface layer of this member was an urethane resin layer, 20 (μm) thick, containing carbon black internally added thereto.

Member AB: The surface layer of this member was an alcohol-soluble nylon resin layer, 20 (μm) thick, containing carbon black internally added thereto.

Member AC: The surface layer of this member was an alcohol-soluble nylon resin layer, 20 (μm) thick, containing perchlorate internally added thereto.

Member AD: The surface layer of this member was a water-soluble nylon resin layer, 20 (μm) thick, containing carbon black internally added thereto.

Member AE: The surface layer of this member was a polyvinyl butyral resin layer, 20 (μm) thick, containing carbon black internally added thereto.

A quantity of added conductive agent was adjusted so that the resistance values of those members AA to AE are $1\times10^7$ (Ω) in the NN environment. The measuring method shown in FIG. 10 was used for this adjustment.

The results of measuring the resistance values R, the area dependency $1-\beta$ of the resistance, and the current dependency $\gamma$ of the resistance of the those members in the respective environments, as in EXAMPLE 3, are shown in Table 8.

TABLE 8

| Member | LL | | | NN | | | HH | | |
|---|---|---|---|---|---|---|---|---|---|
| | R | $\beta$ | $\gamma$ | R | $\beta$ | $\gamma$ | R | $\beta$ | $\gamma$ |
| AA | $3\times10^7$ | 0.98 | 0.35 | $1\times10^7$ | 0.95 | 0.26 | $5\times10^6$ | 0.95 | 0.22 |
| AB | $2\times10^7$ | 0.95 | 0.44 | $1\times10^7$ | 0.93 | 0.35 | $6\times10^6$ | 0.93 | 0.32 |
| AC | $5\times10^7$ | 1.0 | 0.36 | $1\times10^7$ | 1.0 | 0.15 | $3\times10^6$ | 0.95 | 0.1 |
| AD | $9\times10^7$ | 1.0 | 0.88 | $1\times10^7$ | 0.90 | 0.66 | $1\times10^6$ | 0.85 | 0.35 |
| AE | $1\times10^8$ | 1.0 | 0.8 | $1\times10^7$ | 0.95 | 0.52 | $2\times10^6$ | 0.92 | 0.4 |

As shown in Table 8, the resistance R, the area dependency $1-\beta$ of the resistance, and the current dependency $\gamma$ of the resistance of the those members were varied depending on the environments. This was slightly different from the contents shown in Table 6. The area dependency $1-\beta$ of the resistance depends on the member used, but generally decreases with increase of the resistance value of the member. The current dependency $\gamma$ tends to be large as the resistance of the member increases.

Then, defects each of 0.3 (mmφ) were intentionally formed in members to be charged. Each of the defect marred members to be charged and each of the members AA to AE were set to the image forming apparatus shown in FIG. 14. Actually, images were formed in the LL, NN and HH environments and states of images were inspected. The restricted current .value of the power source was −9 (μA). The results of the inspection are shown in Table 9.

Check was made as to whether the formula (17) is satisfied or not, using R, $\gamma$, $\beta$, and Va=−1.16 (kV), I=−6 (μA), k=−3 (μA), and S/s=9600. Table 9 also shows the results of this check.

In Table 9, in the "image" column, BD (black dot) indicates that a black dot appears on the image, and BS (black stripe) indicates that a black stripe elongating in the axial direction of the roller appears on the image. In the "Inequality (17)" column, ○ indicates that the formula is satisfied, and x indicates that the formula is not satisfied. Calculation values of right sides of the inequality (17) are also shown.

TABLE 9

| Member | LL | | NN | | HH | |
|---|---|---|---|---|---|---|
| | Image | Inequality (17) | Image | Inequality (17) | Image | Inequality (17) |
| AA | BD | ○ 6.0 | BD | ○ 5.8 | BD | ○ 5.6 |
| AB | BD | ○ 6.4 | BD | ○ 6.2 | BD | ○ 6.1 |
| AC | BD | ○ 5.9 | BD | ○ 5.2 | BD | ○ 5.2 |
| AD | BD | ○ 7.8 | BS | x 7.4 | BS | x 6.5 |
| AE | BD | ○ 7.6 | BD | ○ 6.7 | BS | x 6.4 |

As seen from the results shown in Table 9, in the case of the members satisfying the inequality (17), if the member to be charged marred by the pinhole is used for image formation, the defects of the images formed are not serious. This fact was confirmed again.

In another test, the members AA, AB and AC not causing defects in the formed images in all the environments were set to the image forming apparatus shown in FIG. 14, and images were formed on 10,000 sheets of transferred-image recording medium of A4 size in a room where temperature and humidity were not adjusted. No deterioration of the images was not observed.

When examining the formulae (8), (13) and (17), it is seen that the members of which the area dependency and the current dependency are small, are easy to satisfy the formulae. The results of the examples 1 and 7 show that the layer made of a material selected from among urethane rubber, urethane resin, and nylon resin, particularly alcohol-soluble resin, and polyethylene resin, is preferably formed on the surface of the charging member (i.e., the surface to come in contact with the member to be charged). Also where a nylon resin film of 40 (μm) thick is used for the charging member, folded in two as shown in FIG. 11(*h*), no defects were found in the image in all the environments. The film used was a called nylon resin single layer film.

EXAMPLE 8

The following members H to J each of 22 (cm) in the effective length were used for the transfer member of a contact transfer device. The member to be charged used was that of EXAMPLE 1.

Member H: Roller with a conductive layer made of urethane foam containing carbon black internally added thereto (volume resistivity: $10^7$ (Ω cm), Asker C hardness: 35 (°), cell diameter: 300 (μm), and thickness: 5 (mm)).

Member I: Roller with a conductive layer made of urethane foam containing carbon black internally added thereto (volume resistivity: $10^8$ (Ω cm), Asker C hardness: 35 (°), cell diameter: 300 (μm), and thickness: 5 (mm)).

Member J: Roller with a conductive layer made of skin, silicon foam containing carbon black internally added thereto (volume resistivity: $10^8$ (Ω cm), Asker C hardness: 30 (°), and thickness: 5 (mm)).

Before an experiment is conducted, each transfer member was set to the image forming apparatus shown in FIG. 15. A transfer voltage was set at +800 (V). The current I, which flows into the member to be charged under this voltage, was measured. The peripheral speed of the member to be charged was 3 (cm/sec). The measured current I was 2 (μA).

Defects each of 0.3 (mmϕ) were intentionally formed in members to be charged. Each of the defect marred members to be charged and each of the members H to J were set to the image forming apparatus shown in FIG. 15. Actually, images were formed and states of images were inspected. Every time the member was replaced with another, the member to be charged was replaced with a new one. The restricted current value of the power source was 15 (μA). The results are shown in Table 10.

The resistance values R of the members were measured by the measuring method shown in FIG. 10. The measuring current was 2 (μA). The area dependency $1-\beta$ of the member resistance and the current dependency $\gamma$ thereof were measured. Check was made as to whether or not the formula (8) or (17) is satisfied. The results of the measurement and the check are also shown in Table 10. In this table, in the "formula" columns, ◯ indicates that the formula is satisfied, and x indicates that the formula is not satisfied. Calculation values of right sides of the formulae are also shown.

TABLE 10

| Member | Image | log (R) | $\beta$ | $\gamma$ | (8) | (17) |
|---|---|---|---|---|---|---|
| H | White strip | 6.1 | 0.61 | 0.51 | x 8.8 | x 8.3 |
| I | Good | 7.2 | 0.72 | 0.35 | x 8.1 | ◯ 7.2 |
| J | Good | 7.0 | 0.85 | 0.21 | x 7.4 | ◯ 6.1 |

As seen from Table 10, when neither the formula (8) or (17) is satisfied, a poor transfer (white stripe) appears in the image.

In another test, the members AA, AB and AC, and a member to be charged not suffering from defects were set to the image forming apparatus shown in FIG. 15, and images were formed on 10,000 sheets of transferred-image recording medium of A4 size. No white stripes were observed in the images.

EXAMPLE 9

The members I and J used in EXAMPLE 8 were used for the transfer member of a contact transfer device. The method similar to that of EXAMPLE 8 was used. During the period of forming an image on the photoreceptor layer, viz., before the transfer process, a cleaning voltage −250 (V) for cleaning the transfer member was applied to the transfer member. After a toner image is formed on the photoreceptor layer, the image is transferred onto the transfer member.

In another test, the members I and J, and a member to be charged not suffering from defects were set to the image forming apparatus shown in FIG. 15, and images were formed on 10,000 sheets of transferred-image recording medium of A4 size. No white stripes were observed in the images.

In this example, when the transfer voltage is applied, both the members I and J satisfy the inequality (17). Accordingly, also when the cleaning voltage is applied, the above-mentioned conditions hold.

Since the cleaning voltage is usually smaller than the breakdown voltage of the underlayer, check was made as to whether or not the formula (13) or (17) was satisfied. Both the formulae were satisfied.

Thus, if any of the formulae (8), (13) and (17) is satisfied, no poor transfer occurs, no enlargement of the defects and pinholes in the photoreceptor layer is made, and no deterioration of the members is made irrespective of application of the cleaning voltage. This fact was confirmed.

EXAMPLE 10

The roller constructed as shown in FIG. 11(*a*) was used for the charging member of a contact transfer device. A solid, conductive urethane as a conductive layer was formed on the roller. The resistance of the conductive urethane was varied. Charging members a to j as shown in Table 11 were prepared. The resistance values R of the members were measured by the FIG. 10 method. In Table 11, the resistance value R is denoted merely as R.

The member to be charged was structured such that an underlayer of anodized aluminum is formed on a conductive base member made of aluminum, and a photoreceptor layer was layered on the underlayer.

The breakdown voltage Vt of the anodized aluminum layer as the underlayer was measured. In the measurement, the conductive base member was earthed, and a voltage of the same polarity as the charge voltage was applied to the surface of the anodized aluminum layer for one minute. The highest voltage within which the underlayer is not broken down was measured. The area S of the electrode brought into contact with the anodized aluminum layer was 6.15 ($cm^2$), and the load per unit area was 163 ($g/cm^2$) (gross load: 1000 (g)).

In the results of the measurement, the breakdown voltage Vt of the anodized aluminum layer was −300 (V), the current i was −100 (μA), and the current density in the contact area with the electrode was 16 ($\mu A/cm^2$). The measurements were carried out 30 times. [(average value) +(3×standard deviation)]of the resistance Rp of the anodized aluminum layer was $4.3\times10^6$ (Ω).

By changing the area of the electrode, the resistance of the anodized aluminum layer was measured, to obtain the area dependency $1-\alpha$ of the resistance. $\alpha=1$, that is, the resistance of the anodized aluminum layer was proportional to the area. Accordingly, the resistance of the anodized aluminum layer when seen from the defect was $4.3\times10^{10}$ (Ω) where the pinhole area $a=6.15\times10^{-4}$ ($cm^2$) (corresponding to 0.28 (mmϕ)). The current density was set at the same value as above (16 ($\mu A/cm^2$)), The area dependency $1-\beta$ of the resistance of the members a to j were obtained. By changing the electrode area, the resistance values were measured. The result was that the resistance values of the members a to j were inversely proportional to the area, and D=1. The current dependency γ of the resistance of the members a to j were obtained. γ=1 for each of the members. The pinhole resistance Rq is $10^4$ times as large as the member resistance R, as seen from Table 11.

The charging member was brought into contact with the underlayer, with the photoreceptor layer not intervening therebetween. A voltage was applied to the charging member. Check was made as to whether or not the underlayer is dielectrically broken down. From our study, we knew the fact that the voltage for charging the surface of the member to be charged to a potential depends on the resistance of the charging member. Hence, the voltages Va to charge the surface of the photoreceptor layer to −600 (V) were set as shown in Table 11. The application of the voltages continued for one minute.

The results were shown in Table 11. x indicates that the underlayer is broken down, and ○ indicates that it is not broken down.

The voltage applied to the underlayer, as already referred to, $$Va\times rq/(rq+Rq),$$

and the calculated values are described in the "divided voltage" columns.

TABLE 11

| Member | a | b | c | d | e | f | g | h | i | j |
|---|---|---|---|---|---|---|---|---|---|---|
| R (Ω) | 1.7E6 | 3.5E6 | 6.9E6 | 1.2E7 | 1.7E7 | 3.5E7 | 6.9E7 | 1.2E8 | 1.7E8 | 3.5E8 |
| Rq (Ω) | 1.7E10 | 3.5E10 | 6.9E10 | 1.2E11 | 1.7E11 | 3.5E11 | 6.9E11 | 1.2E12 | 1.7E12 | 3.5E12 |
| Va (−V) | 1145 | 1170 | 1170 | 1170 | 1170 | 1170 | 1170 | 1270 | 1300 | 1357 |
| Underlayer breakdown | x | x | x | x | ○ | ○ | ○ | ○ | ○ | ○ |
| Divided voltage (−V) | 817 | 648 | 448 | 307 | 233 | 129 | 68 | 44 | 32 | 17 |

As seen also from Table 11, in the case of the members a to d, a voltage higher than the breakdown voltage Vt is applied to the underlayers, so that the underlayer is broken down. In the case of the members e to j, a divided voltage, lower than the breakdown voltage, is applied thereto. Then, the underlayer will not be broken down.

Each of the members a to j was pressed against a member to be charged in which a defect of 0.28 (mmϕ) was formed in the photoreceptor layer at the load of 1000 (g) (the load per unit area is equal to that in the resistance measurement). The member is arranged so as to turn following the rotation of the member to be charged. Images were formed. The development was the reversal development. In the case of the members a to c, currents leaked at the defects. Poor charge occurs over the entire range of the nip between each member and the member to be charged. Black stripes appeared on the printed images at the rotation periods.

After the experiment, it was confirmed that the resistance of the underlayer of the part right under the defect was considerably reduced, and the defect part was destroyed to grow into a pinhole. In the case of the member d, current leaks at the defect part, but poor charge did not extend over the entire range of the nip between the member and the member to be charged. The resultant image was almost satisfactory, except a black dot appearing in the image. Repeating the print, the black dot gradually grew. After 200 sheets of prints, black stripes appeared in the images at the rotation periods. Our visual check showed that the defect of the member to be charged was enlarged to be a pinhole of about 1 (mmϕ).

In the case of the members e to j, no leak current was observed, and no black stripe appeared in the images. 20,000 sheets of prints was gained at print quality satisfactory in practical use. After 20,000 sheets of prints, neither expansion of the defect nor breakdown of the underlayer was observed by our visual check.

In <EXAMPLE 10>, the charging member and the member to be charged are both 0 in the area dependency of their resistance. Therefore, even if defects of 0.1 to 1 (mmϕ), in addition to the defect of 0.28 (mmϕ) are present in the member to be charged, the members e to j will not break down the underlayers (anodized aluminum layer), and the defects will not be grown into pinholes. This fact was confirmed.

EXAMPLE 11

The underlayer of the member to be charged is a high-molecular organic layer of which the resistance was controlled by a resistance control agent. The conductive elastic layer of the charging member was made of an open-cell type urethane foam of which the cell diameter is 30 (μm) when measured by the bubble point method. The remaining construction was the same as that of EXAMPLE 10, and the experiments conducted were substantially the same as those of EXAMPLE 10.

The specifications of the underlayer were: the breakdown voltage Vt=−400 V, resistance $Rp=1\times10^6$ (Ω) (current i was −400 (μA) and the area S was 6.2 ($cm^2$));

and $\alpha=1$. The underlayer resistance rq ($6.15\times10^{-4}$ ($cm^2$), viz., corresponding to 0.28 (mmϕ), when seen from the defect was $1\times10^{10}$ (Ω).

Members k to t of different resistance R were used for the charging member. These members were different from those in EXAMPLE 10 in that the area dependency $1-\beta$ of the resistance was 0.75, not 0. And the current dependency $\gamma$ was also not 0. The resistance values shown in Table 12 are the resistance values Ru of the members when current of −400 (μA) was fed to the area 6.2 ($cm^2$). The underlayer resistance values Rq when seen from the defects are also shown in the table.

The charging member was brought into contact with the underlayer, with the photoreceptor layer not intervening therebetween. A voltage was applied to the charging member. Check was made as to whether or not the underlayer is dielectrically broken down.

The results were shown in Table 12. x indicates that the underlayer is broken down, and ○ indicates that it is not broken down. The voltage values Va applied to the members were also shown therein.

The voltage divided to the underlayer, as already referred to, $$Va\times rq/(rq+Rq),$$

and the calculated values of the voltage are also shown in Table 12. In Table 12, these are described in the column "Divided voltage". The calculation results of the following relation are also described in Table 12, in the column "Reference".

$$Va\times rq/(Rp+Ru),$$

which is based on the assumption that the voltage applied to the underlayer depends on resistance values Rp and Ru, not the resistance values rq and Rq when seen from the defects.

TABLE 12

| Member | k | l | m | n | o | p | q | r | s | t |
|---|---|---|---|---|---|---|---|---|---|---|
| Ru (Ω) | 5.0E5 | 1.0E6 | 2.0E6 | 4.0E6 | 7.0E6 | 1.0E7 | 2.0E7 | 4.0E7 | 7.0E7 | 1.0E8 |
| Rq (Ω) | 5.0E8 | 1.0E9 | 2.0E9 | 4.0E9 | 7.0E9 | 1.0E10 | 2.0E10 | 4.0E10 | 7.0E10 | 1.0E11 |
| Va (−V) | 1042 | 1100 | 1154 | 1170 | 1170 | 1170 | 1170 | 1170 | 1225 | 1255 |
| Underlayer breakdown | x | x | x | x | x | x | ○ | ○ | ○ | ○ |
| Divided voltage (−V) | 993 | 1000 | 964 | 836 | 688 | 585 | 390 | 234 | 153 | 114 |
| Reference (−V) | 695 | 550 | 386 | 234 | 146 | 106 | 56 | 29 | 17 | 12 |

As seen from Table 12, in the case of the members k to [, a divided voltage higher than the breakdown voltage Vt is applied to the underlayers, so that the underlayer is broken down. In the case of the members q to t, a divided voltage, lower than the breakdown voltage, is applied thereto. Then, the underlayer will not be broken down. In this case, it will be seen again that the resistance values of the member when seen from the defect or pinhole and the resistance of the underlayer must be used for the calculation. That is, as in the conventional case, the values in the column "Reference" are not the divided voltage values for the underlayers (otherwise, the members m to t could not break down the underlayers), but the resistance values of the member when seen from the defect or pinhole and the resistance of the underlayer must be used.

Each of the members k to t was pressed against a member to be charged in which a defect of 0.28 (mmϕ) was formed in the photoreceptor layer, and images were formed. In the case of the members k to o, currents concentrically leaked at the defects. Current was little distributed over the entire range of the nip between each member and the member to be charged. This results in poor charge, and black stripes appeared on the printed images at the rotation periods. After the experiment, it was confirmed that the resistance of the part of the anodized aluminum layer, which is right under the defect, was considerably reduced, and the defect part was destroyed to grow into a pinhole.

In the case of the member p, current leaks at the defect part, but its value is restricted below a predetermined value. Current of such a value as to charge could be distributed over the entire range of the nip between each member and the member to be charged. The resultant image was almost satisfactory, except a black dot appearing at a limited area of poor charge, or the defective part, in the image. Repeating the print, the black dot gradually grew. After 200 sheets of prints, black stripes appeared in the images at the rotation periods. Our visual check showed that the defect of the member to be charged was enlarged to be a pinhole of about 1 (mmϕ) after 200 sheets of prints.

In the case of the members g to t, no leak current was observed, and no black stripe appeared in the images. 20,000 sheets of prints was gained at print quality satisfactory in practical use. After 20,000 sheets of prints, neither expansion of the defect nor breakdown of the underlayer was observed by our visual check.

EXAMPLE 12

The condition to avoid the breakdown of the intermediate layer (or underlayer) will be discussed again.

Figure 18A:
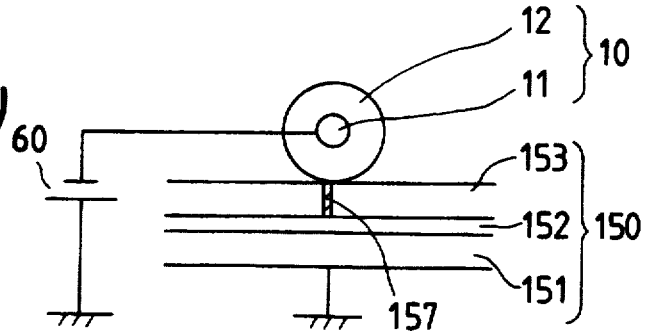
FIGS. 18(*a*) and 18(*b*) are a sectional view schematically showing a contact charging device being in contact with a photoreceptor layer marred by pinholes and a sectional view schematically showing a method to check whether or not the intermediate layer (or underlayer) of the photoreceptor drum is broken down.
Figure 18B:
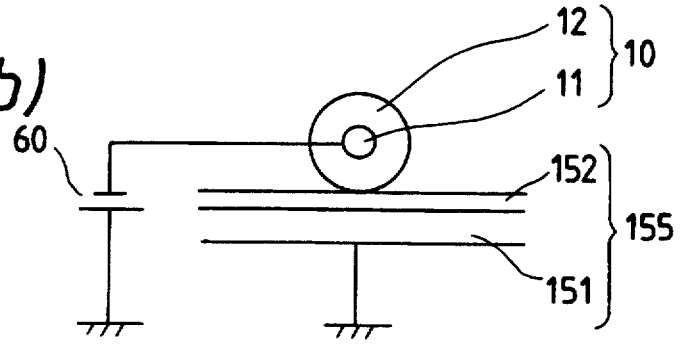

FIGS. 18(*a*) and 18(*b*) are a sectional view schematically showing a contact charging device in which a photoreceptor member 150 is used for a member to be charged, and a charging member 10 is used for charging it. In this example, the photoreceptor member 150 is constructed such that an intermediate layer 152 is formed on a conductive support member 151, and a photoreceptor layer 153 of made of organic or inorganic photosensitive material is further layered on the intermediate layer. If a pinhole 157 is formed in the photoreceptor layer 153 by foreign material mixed thereinto or scratch, the intermediate layer 152 will not be physically and chemically changed. A charging member 10 is as described referring to FIG. 11(*a*), and a conductive base member 11 is connected to a power source 60.

Figure 19:
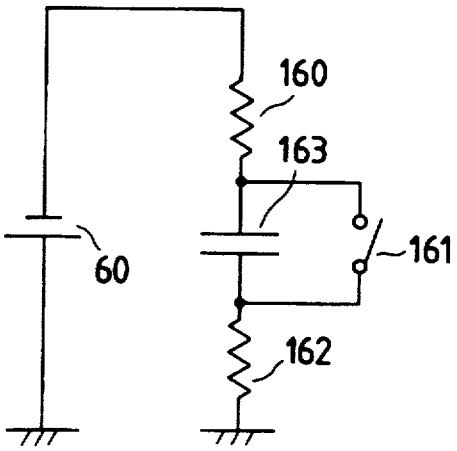
FIG. 19 is an equivalent circuit of a contact charging device according to the present invention.

FIG. 19 is an equivalent circuit of the contact charging device shown in FIG. 18(*a*). Resistance of the conductive base member 11 of the charging member 10 is considerably smaller than that of the conductive elastic-layer 12, and negligible. The resistance of the conductive elastic-layer 12 is represented by resistance 160 of the conductive elastic-layer 12. When the photoreceptor layer is not marred by a pinhole, current fed from the power source 60 flows into a capacitor 163 of the photoreceptor layer, through the resistor 160. The voltage from the power source 60 has the same polarity as for charging. A switch 161 presented by the pinhole is in an off state, the capacitor 163 of the photoreceptor layer retains charges therein.

When a pinhole is formed in the photoreceptor layer 153 by foreign material mixed thereinto or scratch, the switch 161 is turned on. The voltage Va from the power source 60 is applied to across the gross resistance of the charging circuit model, viz., the sum (Ra+Rb) of the resistance (denoted as Ra) of the conductive elastic-layer 12 and the resistance (denoted as Rb) of the intermediate layer. The voltage shared by the resistor 162 of the intermediate layer is denoted as Vc. Then, we have $$Vc/Va=Rb/(Ra+Rb),$$

Rearranging this equation, we have $$Vc=Va\times Rb/(Ra+Rb).$$

If the pinhole is formed in the photoreceptor layer, the intermediate layer will not be broken down so long as the voltage Vc is below the breakdown voltage (denoted as Vb) of the intermediate layer. Under this condition, the current (denoted as I1), restricted by the sum resistance (Ra+Rb), is allowed to flow.

When Vc>Vb, the intermediate layer is broken down, and the current (denoted as I2) restricted by the resistance Ra leaks. Since I1<I2, an increased current flows when the intermediate layer is broken down. Accordingly, if Va, Ra, and Rb are selected so as to satisfy the following inequality $$|Vb|\geqq|Vc|$$

hence, $|Vb|\geqq|Va|\times Rb/(Ra+Rb)$, a voltage higher than the breakdown voltage will not be applied to the intermediate layer even when a pinhole is formed in the photoreceptor layer by foreign material mixed thereinto or scratch. Accordingly, the intermediate layer is not broken down and no leak current flows. No voltage drop takes place, and neither a black stripe nor a white stripe appears in the printed image. Since no leak current flows after a pinhole is formed in the photoreceptor layer, the pinhole will not grow, so that the photoreceptor layer marred by the pinhole can be used for a long time.

The application of the invention for an actual image forming apparatus based on the electrophotography system will be described. The charging member used in the contact charging device of the invention is already described with reference to FIGS. 11(*a*) to 11(*f*). As a matter course, the structure and the material of the charging member are not limited to those described in connection with FIGS. 11(*a*) to 11(*f*). For example, a solid discharge member can be used, although it is used in a noncontact fashion, that is, a gap of several μm to several tens μm is kept between the surface of the solid discharge member and the surface of the photoreceptor layer. The resistance Ra is a resistance in the portion ranging from the conductive support member of the solid discharge member to the surface thereof.

We had two facts on the resistance of the charging member.

i) The resistance is not inversely proportional to the contact area of the charging member with the electrode.

The electrodes of different sizes were brought into contact with the surface of the charging member. And resistance between the conductive base member and the electrodes were measured. The measured values of resistance were plotted with respect to the sizes of the electrodes. The fact that the resistance is not inversely proportional to the contact area of the charging member with the electrode, was confirmed from the graph.

Figure 20A:
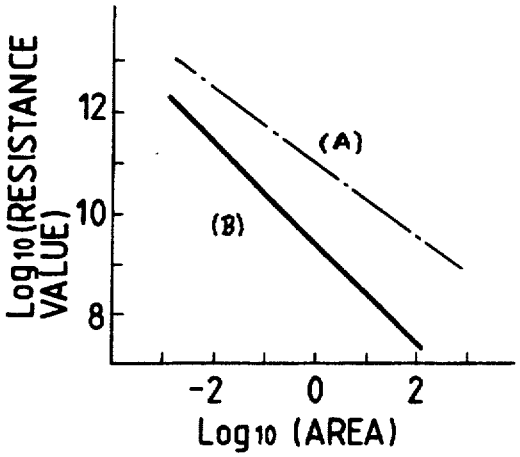
FIGS. 20(*a*) and 20(*b*) show a graph showing the area dependency of resistance of the charging member and a graph showing area dependency of resistance of the intermediate layer of the photoreceptor drum.
Figure 20B:
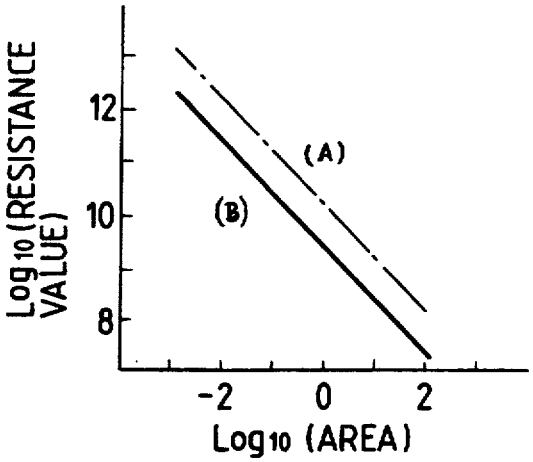

FIG. 20 shows a graph showing the area dependency of resistance of the charging member and a graph showing the area dependency of resistance of the intermediate layer of the photoreceptor drum. In each of these graphs, the abscissa represents common logarithmic values of the electrode area S ($mm^2$), while the ordinate represents common logarithmic values of resistance R (Ω). In the graphs, a characteristic straight line (A) indicates a resistance of the charging member. A characteristic rectilinear line (B) is representative of resistance of the intermediate layer. The straight lines (B) in FIG. 20(*a*), (A) in FIG. 20(*b*), and (B) in FIG. 20(*b*) are inclined at −1. The resistance is inversely proportional to the area. Accordingly, when the electrode area is 1/10,000, the resistance values is increased 10,000 times. The straight line (A) in FIG. 5(*a*), having an inclination of −0.75, shows that the resistance is not inversely proportional to the area. Accordingly, when the electrode area is 1/10,000, the resistance values is increased only 1000 times. The characteristic of resistance of the charging member with respect to the contact area depends on the charging members of different sizes and materials. Because of this, it is difficult to predict the resistance of the area corresponding to a pinhole on the basis of the resistance Of one contact area. Therefore, the resistance of the charging member is measured by using the electrode of the area corresponding to the pinhole. Particularly for measurement of the charging member of high resistance, it is difficult to measure the resistance using the electrode of a minute area. For this reason, the resistance of the area corresponding to the pinhole may be predicted in a manner as shown line (A) in FIG. 20(*a*) that the resistance is measured using the electrodes of different sizes, a straight line is drawn in the logarithmic graph.

Again, it is necessary to directly or indirectly examine the resistance of the charging member and the intermediate layer when the area of the contact electrode corresponds to the pinhole, and to use the results for the resistance Ra or Rb.

ii) Resistance depends on current (or voltage)

Resistance between the conductive base member and the electrode was measured in a manner that the electrode was brought into contact with the charging member, and current or voltage applied was varied. A relationship between the current or voltage and the resistance was plotted in a graph. The graph showed that the resistance values of most charging members depends on the current or voltage.

Figure 21A:
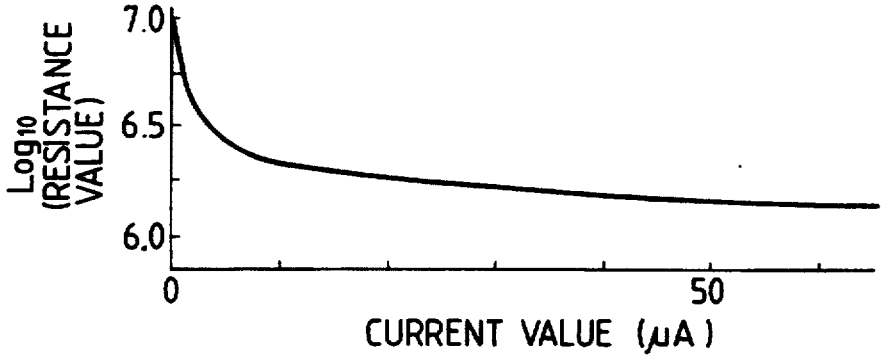
FIGS. 21(*a*) and 21(*b*) are graphs for explaining the current dependency of resistance of a charging member.
Figure 21B:
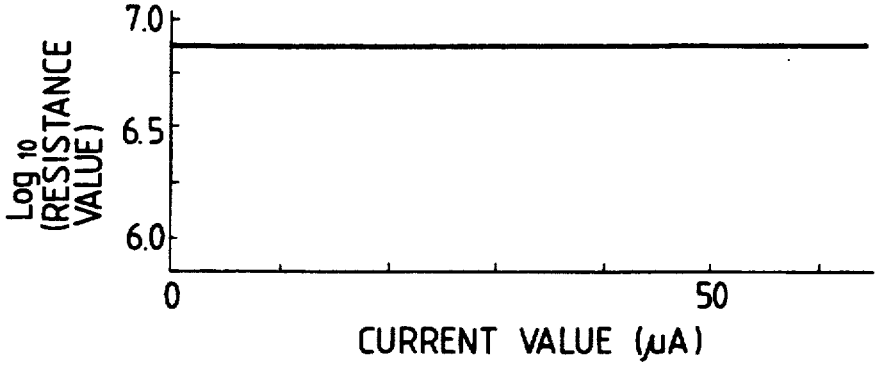

FIG. 21 shows a graph for explaining the current dependency of resistance of the charging member. The abscissa represents current values when current flows to the charging member, while the ordinate, common logarithmic values of resistance of the charging member at that time. FIG. 21(*a*) shows a graph showing an example where the resistance depends on the current. As shown, where the current is small, the resistance is large and vice versa. Accordingly, in measuring the resistance of the charging member, the current density in the contact area between the charging member and the electrode when those come in contact with each other must be substantially equal to the current density (denoted as $\rho i$) when the breakdown voltage is applied to the intermediate layer.

FIG. 21(*b*) shows a graph showing an example where the resistance does not depend on the current. Some types of charging members have not the current dependency of their resistance. Accordingly, those members exhibit constant resistance if the current fed thereto varies. The current value may be properly selected for measuring the resistance of those types of charging members.

For the reasons i) and ii) above, the resistance of the charging member will be measured in the following method.

A charging member is brought into contact with the electrode of a small area corresponding to the pinhole. A load per unit area for the contact is substantially equal to that when the charging member is brought into contact with the photoreceptor layer for charging the latter. The current density in the contact area between the charging member and the electrode when those come in contact with each other is substantially equal to the current density $\rho i$ when the breakdown voltage is applied to the intermediate layer. The resistance is calculated using the voltage and current applied to the charging member. Our study teaches that the size of the pinhole ranges from $\phi 0.05$ mm to $\phi 1$ mm, the minute area corresponding to the pinhole is $2\times10^{-3}$ mm$^2$ (corresponding to $\phi 0.05$ mm) to 3 mm$^2$ (corresponding to $\phi 1$ mm).

The intermediate layer of the photoreceptor drum made of organic or inorganic material. The inorganic material may be any of anodized aluminum ($Al_2O_3$), boehmite AlO(OH)), amorphous silicon oxide, amorphous silicon nitride, amorphous silicon carbide, and the like. The organic material may be any of polyvinyl alcohol, polyvinyl methyl ether, polyvinyl butyral, ethyl cellulose, ethylene acryl acid copolymer, gelatine, maleic acid copolymer, polyurethane resin, epoxy resin, alkyd resin, polyester resin, silicone resin, phenol resin, and the like. A resistance control agent, if necessary, is dispersed or compatibilized into the above resin. The resistance control agent may be any of the following materials: aluminum, copper, nickel, silver, iron oxide, tin oxide, antimony oxide, indium oxide, zinc oxide, titanium oxide, aluminum oxide, barium carbonate, calcium carbonate, copper iodide, carbon black, conductive copolymer and the like.

We found that the resistance of the intermediate layer also depends on the current (or voltage). Accordingly, the resistance of the intermediate layer is set at the resistance thereof when it is under the voltage applied thereto. As already described, the resistance of the intermediate layer is substantially inversely proportional to the electrode area.

As seen from the foregoing description, the resistance Rb and Ra in the inequality, $$|Vb| \geqq |Va| \times Rb/(Ra+Rb),$$

must be the resistance (denoted as Rbb) of the intermediate layer and the resistance (denoted as Raa) of the charging member in a supposed minute area thereof corresponding to a pinhole, respectively.

Accordingly, the condition not to break down the intermediate layer is $$|Vb| \geqq |Va| \times Rbb/(Raa+Rbb). \quad (20)$$

Figure 22:
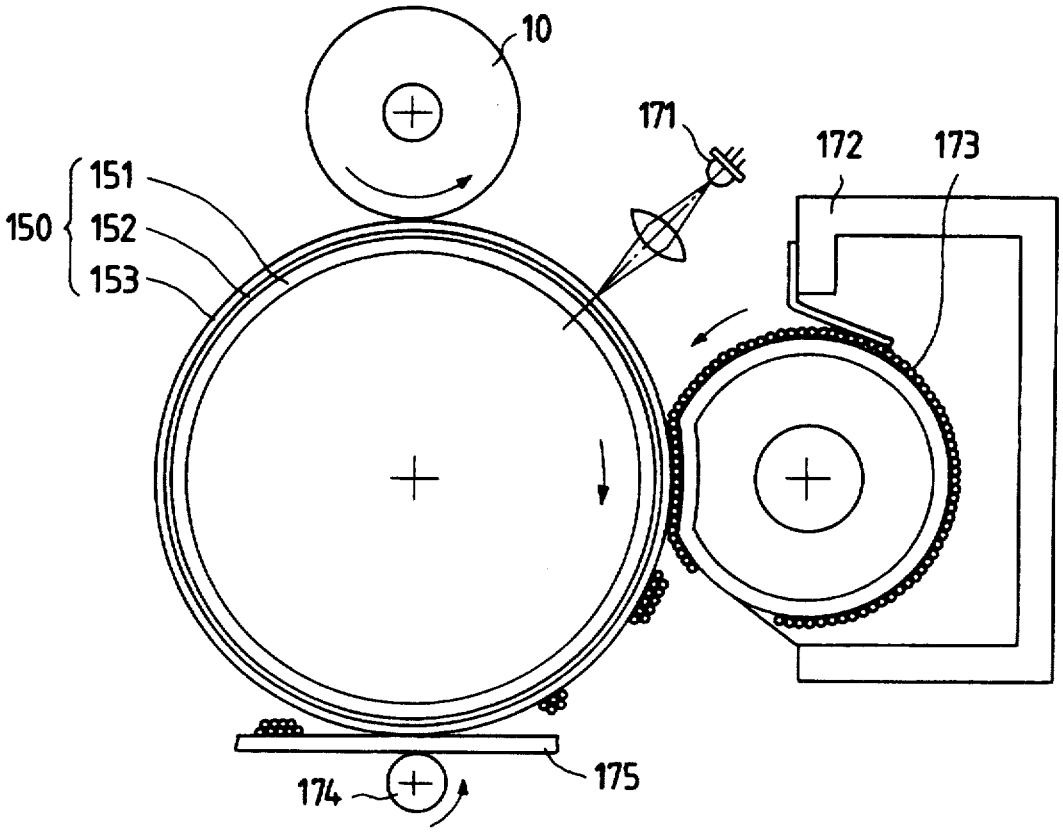
FIG. 22 is a sectional view schematically showing an image forming apparatus incorporating a contact charging device according to the present invention.

FIG. 22 is a sectional view schematically showing an image forming apparatus incorporating a contact charging device according to a specific embodiment of the present invention. In a photoreceptor member 150 as a member to be charged, an intermediate layer 152 is formed on a conductive support member 151, and a photoreceptor layer 153, made of organic or inorganic photosensitive material, is formed on the intermediate layer. The photoreceptor member 150 is charged by a charging member 10, such as a charging roller or a charging blade, constructed as shown in FIG. 11. Then, the charged photoreceptor member is exposed to light 171 corresponding to image information, emitted from a light source, such as a laser device or an LED. The result is the formation of a latent electrostatic image pattern, with gained potential contrast. A developing unit 172 covers toner 173 as image forming material to develop the electrostatic image pattern. A transfer unit 174, such as a transfer roller, transfers a toner image pattern onto a printing paper 175. The transferred toner image is then fused and fixed on the printing paper 175 by heat and pressure, not shown. In this way, a desired image is printed on the printing paper 175.

The results of re-studying the condition not no break down the intermediate layer (or the underlayer) will be described in detail.

EXAMPLE 13

A photoreceptor member was used for the member to be charged. The photoreceptor member was structured such that an anodized aluminum layer as an intermediate layer was formed on a conductive support member made of aluminum, and a photoreceptor layer was formed thereon. The same photoreceptor members were used in experiment conditions 1 to 10 in EXAMPLE 13. To set up the breakdown Voltage of the anodized aluminum layer, the aluminum support member was earthed, and a voltage of the same polarity as the charge voltage was applied to the surface of the anodized aluminum layer for one minute. The highest voltage within which the underlayer is not broken down was used as the breakdown voltage of the anodized aluminum layer. The area S of the electrode brought into contact with the anodized aluminum layer was 6.15 (mm$^2$), and the load per unit area was 1.63 (g/cm$^2$) (gross load: 1000 (g)). The breakdown voltage of the anodized aluminum layer was $-300$ (V), and the current was approximately $-100$ ($\mu$A) under this voltage. The current density $\rho i$ in the contact area thereof with the electrode was 0.16 ($\mu$A/mm$^2$). The measurements were carried out 30 times. [(average value)+(3×standard deviation)] of the resistance, or Rb, of the anodized aluminum layer was $4.3\times10^6$ ($\Omega$). By changing the area of the electrode, the resistance o#the anodized aluminum layer was measured. The result was that the resistance of the anodized aluminum layer was inversely proportional to the area. The resistance Rbb of the anodized aluminum layer was $4.3\times10^{10}$ ($\Omega$) where the pinhole area is 0.061 (mm$^2$) (corresponding to 0.28 (mm$\phi$)). The current density $\rho i$ was set at the same value as above (0.16 ($\mu$A/mm$^2$)).

A charging member 10 is as described referring to FIG. 11(*a*). A roller used was constructed such that a conductive elastic-layer 12, made of solid, conductive polyurethane, was layered on the conductive base member 11. The measurement was conducted in the following manner. The electrode was brought into contact with the surface of the roller. The area S of the electrode brought into contact with the roller surface was 6.15 ($mm^2$), and the load per unit area was 1.63 ($g/cm^2$) (gross load: 1000 (g)). The current fed was approximately $-100$ ($\mu A$). The current density $\rho i$ in the contact area thereof with the electrode was 0.16 ($\mu A/mm^2$), which was equal to that when the breakdown voltage was applied to the anodized aluminum layer. The resistance Ra was $1.7\times10^6$ ($\Omega$). By changing the area of the electrode, the resistance was measured. The result was that the resistance of the roller was inversely proportional to the area ((A) in FIG. 20(*b*)). The resistance Raa was $1.7\times10^{10}$ ($\Omega$) where the pinhole area is 0.061 ($mm^2$) (corresponding to 0.28 ($mm\phi$)). The current density $\rho i$ was set at the same value as above (0.16 ($\mu A/mm^2$)).

Ten number of rollers were prepared for EXAMPLE 13, and used for the experiment conditions 1 to 10 in the example, one for one. The resistance values of the rollers are stepwise increased as the column number increases. These resistance values are shown in Table 13. This table tabulates the experiment conditions 1 to 10 in EXAMPLE 13 and the results thereof in a corresponding manner.

From our study, we knew the fact that the voltage for charging the surface of the photoreceptor layer to a potential depends on the resistance of the charging member. Hence, the voltages to charge the surface of the photoreceptor member to $-600$ (V) were set as shown in Table 14.

The results of an experiment where the roller was brought into contact with the intermediate layer without interlaying the photoreceptor layer therebetween, will be described.

FIG. 18(*b*) is a cross sectional view showing a scheme of an experiment for checking as to whether or not the intermediate layer is broken down by application of the voltage.

A stuff tube 155 is constructed such that an anodized aluminum layer as the intermediate layer 152 is layered on the conductive support member 151. The construction thereof is the same as that of the photoreceptor member 150 except that the photoreceptor layer is not used. A voltage was applied to the roller being pressed against the stuff tube for one minute under the condition of the combinations of the roller resistance and the applied voltage shown in Table 13.

Vcc represents a voltage shared by the intermediate layer where the contact area between the charging member and the intermediate layer is very small. As seen from the comparison of the voltages Vb and Vcc shown in Table 13, the conditions 1 to 4 in EXAMPLE 13 do not satisfy the inequality (20). In the combinations of the conditions 1 to 4 in this example, the intermediate layer was broken down (in Table 13, this state is indicated by "x" in the column "Anodized aluminum layer breakdown"). The combinations of the conditions 5 to 10 in EXAMPLE 13 satisfied the inequality (20). The intermediate layer was not broken down (this state is indicated by "○" in the column "Anodized aluminum layer breakdown").

A measurement in which the photoreceptor member 150 with a photoreceptor layer as in an actual case is used, the charging member 10 is pressed against the photoreceptor member 150, and a preset voltage is applied from the power source 60, will be described. The peripheral speed of the roller was equal to that of the photoreceptor member.

The conditions 1 to 3 in EXAMPLE 13 do not satisfy the inequality (20). Each of the rollers was pressed against a photoreceptor member in which a defect of 0.28 ($mm\phi$) was formed in the photoreceptor layer at the load of 1000 (g) (the load per unit area is equal to that in the resistance measurement). The currents leaked at the pinholes. Poor charge occurs over the entire range of the nip between the roller and the photoreceptor layer. Black stripes appeared on the printed images at the rotation periods. The image quality was remarkably deteriorated. Accordingly, the column "Black stripe" in Table 13 was marked with "x". Before print, the parts of the anodized aluminum layer right under the pinholes were not broken down. After print, these parts were broken down and the resistance therein being remarkably reduced.

The condition 4 in EXAMPLE 13 does not satisfy the inequality (20). As in the case of the conditions 1 to 3 in the EXAMPLE 13, the photoreceptor layers having pinholes were used. The currents leaked at the pinholes. When printed, the printed images suffered from black dots in the initial stage, but the image quality was satisfactory. Continuing the printing, the black dots grew. After 200 sheets of prints, black stripes appeared in the images at the rotation periods. Deterioration of the image quality was remarkable. Accordingly, the column "Black stripe" in Table 13 was marked with "x". Before print, the parts of the anodized aluminum layer right under the pinholes were not broken down. After 200 sheets of prints, the pinhole of the photoreceptor layer was enlarged to have the diameter of $\phi1$ mm, and the anodized aluminum layer was broken down.

The conditions 5 to 10 in EXAMPLE 13 satisfy the inequality (20). As in the case of the conditions 1 to 4 in the EXAMPLE 13, the photoreceptor layers having pinholes were used. No currents leaked at the pinholes. When printed, the printed images suffered from black dots, but the image quality of 20,000 sheets of prints was satisfactory. Accordingly, the column "Black stripe" in Table 13 was marked with "○". After 20,000 sheets of prints, the anodized aluminum layer was not broken down.

The resistance of the rollers used in EXAMPLE 13 did not depend on the current, and was substantially inversely proportional to the contact area between it and the aluminum electrode. A load per unit area for pressing the electrode against the charging roller was nearly equal to that when the resistance Ra and Raa was measured.

The resistance of the anodized aluminum layer was also inversely proportional to the contact area of it with the electrode. Since this resistance depends on the voltage, the applied voltage was set equal to the breakdown voltage of the anodized aluminum layer in the measurement. The current density $\rho i$ was set at the same value as in the measurement of the roller resistance.

Accordingly, the conditions 5 to 10 in EXAMPLE 13 satisfy the inequality (20) not only for the contact area corresponding to $\phi0.28$ mm but also for the contact area of $\phi0.1$ mm to $\phi1$ mm, while the conditions 1 to 4 in EXAMPLE 13 do not satisfy the inequality (20), and it was coincident with the result of print (black stripe).

TABLE 13

| | 1 | 2 | 3 | 4 | 5 | 6 | 7 | 8 | 9 | 10 |
|---|---|---|---|---|---|---|---|---|---|---|
| Va (−V) | 1145 | 1170 | 1170 | 1170 | 1170 | 1170 | 1170 | 1270 | 1300 | 1357 |
| Vb (−V) | 300 | 300 | 300 | 300 | 300 | 300 | 300 | 300 | 300 | 300 |
| Rb (Ω) | 4.3E6 | 4.3E6 | 4.3E6 | 4.3E6 | 4.3E6 | 4.3E6 | 4.3E6 | 4.3E6 | 4.3E6 | 4.3E6 |
| Rbb (Ω) | 4.3E10 | 4.3E10 | 4.3E10 | 4.3E10 | 4.3E10 | 4.3E10 | 4.3E10 | 4.3E10 | 4.3E10 | 4.3E10 |
| Ra (Ω) | 1.7E6 | 3.5E6 | 6.9E6 | 1.2E7 | 1.7E7 | 3.5E7 | 6.9E7 | 1.2E8 | 1.7E8 | 3.5E8 |
| Raa (Ω) | 1.7E10 | 3.5E10 | 6.9E10 | 1.2E11 | 1.7E11 | 3.5E11 | 6.9E11 | 1.2E12 | 1.7E12 | 3.5E12 |
| Vcc (−V) | 817 | 648 | 448 | 307 | 233 | 129 | 68 | 44 | 32 | 17 |
| Anodized aluminum layer breakdown | x | x | x | x | ○ | ○ | ○ | ○ | ○ | ○ |
| Black stripe | x | x | x | x | ○ | ○ | ○ | ○ | ○ | ○ |

In Table 13,

Va: Voltage applied to the charging member in print

Vb: Breakdown voltage of the intermediate layer

Ra: Resistance of the charging member (the current density in the contact area of it with the electrode is equal to that when the voltage is applied to the intermediate layer. The area is the entire nip area; 615 $mm^2$)

Rb: Resistance of the intermediate layer (applied voltage: Vb, area: 615 $mm^2$)

Raa: Resistance of the charging member (the current density in the contact area of it with the electrode is equal to that when the voltage is applied to the intermediate layer. The electrode area: corresponding to $\phi$0.28 mm)

Rbb: Resistance of the intermediate layer (applied voltage: Vb, electrode area: corresponding to $\phi$0.28 mm)

Vcc: Voltage applied to the intermediate layer, $Vcc = Va \times Rbb/(Raa+Rbb)$.

The experiments were carried out as in EXAMPLE 13, except that some different components were used. The different components are the intermediate layer of the photoreceptor member and the material of the charging member.

The resistance of the intermediate layer was adjusted by an organic polymeric substance. The breakdown voltage of the intermediate layer was high, −400 V. The current flowing through the intermediate layer under this voltage was −400 μA (its contact area with the electrode was 620 $mm^2$, a negative voltage was applied to the electrode, and the conductive support member was earthed.). The current density $\rho i$ was 0.65 $\mu A/mm^2$. The resistance Rb was 1 MΩ, lower than that of the intermediate layer in EXAMPLE 13. By changing the area of the electrode, the resistance was measured. The result was that the resistance of the intermediate layer was inversely proportional to the area. The resistance was $1.0 \times 10^{10}$ (Ω). The current density $\rho i$ was set at the same value as above (0.65 $\mu A/mm^2$).

The construction of the charging member was substantially equal to that of EXAMPLE 13.

The conductive elastic layer, unlike that in EXAMPLE 13, was made of an open-cell type urethane foam. The cell diameter measured by the bubble point method was 30 μm. Ten number of rollers were prepared as in EXAMPLE 13. The resistance values Ra when its contact area with the electrode was 620 $mm^2$, are shown in Table 14. This table tabulates the experiment conditions 1 to 10 in EXAMPLE 14 and the results thereof in a corresponding manner. The current density $\rho i$ was set at the same value as that when the breakdown voltage was applied to the intermediate layer (0.65 $\mu A/mm^2$). The resistance characteristic of the roller, unlike that of EXAMPLE 13, depends on the current when measured. The resistance of the roller was not inversely proportional to its contact area with the electrode. When the contact area was reduced by four digits, the resistance was only increased by three digits. Hence, the voltage ratios when the charging member comes in contact with the photoreceptor member at small areas must be compared. To this end, the diameter of the pinhole was set to about $\phi$0.28 mm (its area: 0.061 $mm^2$). the roller resistance was predicted on the basis of the area dependency of the resistance by the method as referred to above The resistances having an area of 0.061 $mm^2$ denoted as Raa, are shown in Table 14. The current density $\rho i$ was adjusted so as to be the same value as above (0.65 $\mu A/mm^2$). The remaining measuring conditions were substantially the same as those EXAMPLE 13. In Table 14, the voltage Vc was calculated using the resistance Ra and Rb, and the voltage Vcc was calculated using the resistance Raa and Rbb.

The results of an experiment where the roller was brought into contact with the intermediate layer without interlaying the photoreceptor layer therebetween, will be described.

A voltage was applied to the roller being pressed against the stuff tube for one minute under the condition of the combinations of the roller resistance and the applied voltage shown in Table 14. As seen from the comparison of the voltages Vb and Vcc shown in Table 14, the conditions 1 to 6 in EXAMPLE 14 do not satisfy the inequality (20). In the combinations of the conditions 1 to 6 in this example, the intermediate layer was broken down (in Table 14, this state is indicated by "x" in the column "intermediate layer breakdown").

The combinations of the conditions 7 to 10 in EXAMPLE 14 satisfied the inequality (20). The intermediate layer was not broken down (this state is indicated by "○" in the column "intermediate layer breakdown").

The results of an experiment where the roller was brought into contact with the photoreceptor member having a photoreceptor layer as in an actual case, will be described.

In the conditions 1 to 5 in EXAMPLE 14, $|Vb| < |Vcc|$, these conditions did not satisfy the inequality (20). The conditions 3 to 5 in EXAMPLE 14 allows $|Vb| > |Vc|$ to hold and hence satisfied the inequality, $|Vb| \geqq |Va| \times Rb/(Ra+Rb)$. Each of the rollers was pressed against a photoreceptor member in which a defect of 0.28 (mm$\phi$) was formed in the photoreceptor layer at the load of 1000 (g). In the condition 1 to 5, the currents leaked at the pinholes. Poor charge occurs over the entire range of the nip between the roller and the photoreceptor layer. Black stripes appeared on the printed images at the rotation periods. The image quality was remarkably deteriorated. Accordingly, the column "Black stripe" in Table 14 was marked with "x". The peripheral speed of the roller was equal to that of the photoreceptor member. Before print, the parts of the intermediate layer right under the pinholes were not broken down. After print, these parts were broken down.

From this, the fact that for the condition not to break down the intermediate layer (or underlayer), the inequality, or the inequality (20), $$|Vb| \geqq |Va| \times Rbb/(Raa+Rbb),$$

not $$|Vb| \geqq |Va| \times Rb/(Ra+Rb),$$

must be used, was confirmed.

In the condition 6 in EXAMPLE 14, $|Vb| < |Vcc|$, this conditions did not satisfy the inequality (20). As in the conditions 1 to 5 in EXAMPLE 14, the photoreceptor member having a pinhole was used. The currents leaked at the pinholes. When printed, the printed images suffered from black dots in the initial stage, but the image quality was satisfactory. Continuing the printing, the black dots grew. After 200 sheets of prints, black stripes appeared in the images at the rotation periods. Deterioration of the image quality was remarkable. Accordingly, the column "Black stripe" in Table 14 was marked with "x". Before print, the parts of the intermediate layer right under the pinholes were not broken down. After 200 sheets of prints, the pinhole of the photoreceptor layer was enlarged to have the diameter of $\phi$1 mm, and the intermediate layer was broken down.

In the conditions 7 to 10 in EXAMPLE 14, $|Vb| > |Vcc|$ and the conditions satisfy the inequality (20). As in the case of the conditions 1 to 6 in the EXAMPLE 14, the photoreceptor layers having pinholes were used. No currents leaked at the pinholes. When printed, the printed images suffered from black dots, but the image quality of 20,000 sheets of prints was satisfactory. Accordingly, the column "Black stripe" in Table 14 was marked with "○". After 20,000 sheets of prints, the intermediate layer was not broken down.

TABLE 14

| | 1 | 2 | 3 | 4 | 5 | 6 | 7 | 8 | 9 | 10 |
|---|---|---|---|---|---|---|---|---|---|---|
| Va (−V) | 1042 | 1100 | 1157 | 1170 | 1170 | 1170 | 1170 | 1170 | 1225 | 1225 |
| Vb (−V) | 400 | 400 | 400 | 400 | 400 | 400 | 400 | 400 | 400 | 400 |
| Rb (Ω) | 1.0E6 | 1.0E6 | 1.0E6 | 1.0E6 | 1.0E6 | 1.0E6 | 1.0E6 | 1.0E6 | 1.0E6 | 1.0E6 |
| Rbb (Ω) | 1.0E10 | 1.0E10 | 1.0E10 | 1.0E10 | 1.0E10 | 1.0E10 | 1.0E10 | 1.0E10 | 1.0E10 | 1.0E10 |
| Ra (Ω) | 5.0E5 | 1.0E6 | 2.0E6 | 4.0E6 | 7.0E6 | 1.0E7 | 2.0E7 | 4.0E7 | 7.0E7 | 1.0E8 |
| Raa (Ω) | 5.0E8 | 1.0E9 | 2.0E9 | 4.0E9 | 7.0E9 | 1.0E10 | 2.0E10 | 4.0E10 | 7.0E10 | 1.0E11 |
| Vc (−V) | 695 | 550 | 386 | 234 | 146 | 106 | 56 | 29 | 17 | 12 |
| Vcc (−V) | 993 | 1000 | 964 | 836 | 688 | 585 | 390 | 234 | 153 | 114 |
| intermediate layer breakdown | x | x | x | x | x | x | ○ | ○ | ○ | ○ |
| Black stripe | x | x | x | x | x | x | ○ | ○ | ○ | ○ |

In the examples as mentioned above, it is required that any of the formulae (8), (13) and (17) is satisfied. It is evident that in the present invention, the satisfaction of any combination of these formulae, such as the formulae (8) and (13) or all of the formulae (8), (13) and (17), is allowed.

As described above, in a contact charge supply device for controlling the charges, which are supplied to a member to be charged by bringing a contact member applied with an external voltage in contact with the member to be charged, any of the following inequalities holds $$\log(R) \geqq \log(55\ Rp \times (Va-Vt)/Vt\} + (\alpha-\beta) \times \log(S/s) + \gamma \times \log(i/I) \quad (A)$$

where $|Va|\ |Va| \geqq |Va|\ |Vt|$ $$a+b \geqq Va \times 10^6/j \quad (B)$$

where $$|Va| < |Vt|,\ \log(a) = \log(R) + (\beta-\gamma) \times \log(S/s) - \gamma \times \log(j/I)$$

$$\log(b) = \log(Rp) + \alpha \times \log(S/s)$$

$$\log(R) \geqq \log(Va \times 10^6/k) + (\gamma-\beta) \times \log(S/s) + \gamma \log(k/I) \quad (C)$$

In the above inequalities,

Va (V): voltage applied to a contact member in contact with the member to be charged I ($\mu$A): current flowing from the contact member to the member to be charged S (cm$^2$): contact area of the member to be charged and the contact member R (Ω): resistance of the contact member when current I ($\mu$A) is fed to an area corresponding to the contact area S (cm$^2$) of the contact member $\gamma$: current dependency of the resistance of the contact member $1-\beta$: area dependency of the resistance of the contact member s (cm$^2$): area of a defective part of the member to be charged Vt (V): breakdown voltage of an underlayer i ($\mu$A): current flowing into an area of the underlayer corresponding to the contact are S (cm$^2$) when a voltage, slightly lower than the breakdown voltage Vt (V), is applied to that area Rp (Ω): resistance of the underlayer when the current i ($\mu$A) flows into the an area of the underlayer corresponding to the contact area S (cm$^2$) when a voltage, slightly lower than the breakdown voltage Vt (V), is applied to that area j ($\mu$A): current allowed to flow into an area of the underlayer corresponding to the defective part are s (cm$^2$)

k ($\mu$A): current allowed to follow into a defective part of the member to be charged.

$1-\alpha$: area dependency of the resistance of the underlayer.

The contact charge supply device according to the present invention includes a contact member which contacts to the member to be charged and to which a voltage is applied. The contact member may be the charging member, transfer member, contact type developing member, contact type cleaning member and a member for disordering a developer remaining on the member to be charged, as described above. Where the contact member satisfies the foregoing formula, the device would not suffer from problems in image defect or any deterioration of the contact member even though the member to be charged has a defect or pinhole.

The present invention thus arranged can certainly prevent present an overcurrent being fed from the contact member concentrically to the defective part of the photoreceptor layer if the photoreceptor layer suffers from a defect. Accordingly, poor charge phenomenon, shaped like a stripe, will never take place. The printed image has a high quality. The contact charge supply device of the invention is free of the destruction of the contact member and the electric circuit by the overcurrent. Thus, the contact charge supply device of the invention is highly reliable.

What is claimed is:

1. A contact charge supply device for controlling the charges, which are supplied to a member to be charged by bringing a contact member applied with an external voltage into contact with the member to be charged, which at least includes an underlayer, characterized in that the following inequality holds $$\log(R) \geqq \log\{Rp \times (Va - Vt)/Vt\} + (\alpha - \beta) \times \log(S/s) + \gamma \times \log(i/I)$$

where $|Va| \geqq |Vt|$

Va (V): voltage applied to a contact member in contact with the member to be charged I (μA): current flowing from the contact member to the member to be charged S ($cm^2$): contact area of the member to be charged and the contact member R (Ω): resistance of the contact member when current I (μA) is fed to an area corresponding to the contact area S ($cm^2$) of the contact member γ: current dependency of the resistance of the contact member $1-\beta$: area dependency of the resistance of the contact member s ($cm^2$): area of a defective part of the member to be charged Vt (V): breakdown voltage of the underlayer i (μA): current flowing into an area of the underlayer corresponding to the contact area S ($cm^2$) when a voltage, slightly lower than the breakdown voltage Vt (V), is applied to that area Rp (Ω): resistance of the underlayer when the current i (μA) flows into the area of the underlayer corresponding to the contact are S ($cm^2$) when a voltage, slightly lower than the breakdown voltage Vt (V), is applied to that area $1-\alpha$: area dependency of the resistance of the underlayer.

2. A contact charge supply device for controlling the charges, which are supplied to a member to be charged by bringing a contact member applied with an external voltage into contact with the member to be charged, which at least includes an underlay, characterized in that the following inequality holds $$a + b \geqq Va \times 10^6/j$$

where $$|Va| < |Vt|,\ \log(a) = \log(R) + (\beta - \gamma) \times \log(S/s) - \gamma \times \log(j/I)$$

$$\log(b) = \log(Rp) + \alpha \times \log(S/s)$$

In the above inequality,

Va (V): voltage applied to a contact member in contact with the member to be charged Vt (V): breakdown voltage of the underlayer I (μA): current flowing from the contact member to the member to be charged S ($cm^2$): contact area of the member to be charged and the contact member R (Ω): resistance of the contact member when current I (μA) is fed to an area corresponding to the contact are S ($cm^2$) of the contact member γ: current dependency of the resistance of the contact member $1-\beta$: area dependency of the resistance of the contact member s ($cm^2$): area of a defective part of the member to be charged j (μA): current allowed to flow into an area of the underlayer corresponding to the defective part area s ($cm^2$)

Rp (Ω): resistance of the underlayer when the current $j \times S/s$ (μA) flows into an area of the underlayer corresponding to the contact area S ($cm^2$)

$1-\alpha$: area dependency of the resistance of the underlayer.

3. A contact charge supply device for controlling the charges, which are supplied to a member to be charged by bringing a contact member applied with an external voltage into contact with the member to be charged, characterized in that the following inequality holds $$\log(R) \geqq \log(Va \times 10^6/k) + (\gamma - \beta) \times \log(S/s) + \gamma \times \log(k/I)$$

where

Va (V): voltage applied to a contact member in contact with the member to be charged I (μA): current flowing from the contact member to the member to be charged S ($cm^2$): contact area of the member to be charged and the contact member R (Ω): resistance of the contact member when current I (μA) is fed to an area corresponding to the contact area S ($cm^2$) of the contact member γ: current dependency of the resistance of the contact member $1-\beta$: area dependency of the resistance of the contact member s ($cm^2$): area of a defective part of the member to be charged k (μA): current allowed to follow into a defective part of the member to be charged.

4. The contact charge supply device of any one of claim 1, 2 and 3, wherein said member to be charged consists of a conductive layer, said underlayer and a dielectric layer arranged in this order.

5. The contact charge supply device of claim 4, wherein said underlayer is formed of one of anodized aluminum and nylon resin.

6. The contact charge supply device of claim 1 or 2, wherein said underlayer is formed of one of anodized aluminum and nylon resin.

7. The contact charge supply device of claim 3, wherein said member to be charged consists of a conductive layer and a dielectric layer arrange din this order.

8. The contact charge supply device of claim 1, 2 or 3, wherein said contact member is formed of one of a contact-type developing member, contact-type cleaning member and a member for disordering a developer remaining on said member to be charged.

9. A contact charging device for charging or discharging a member to be charged by bringing a charging member applied with an external voltage into contact with the member to be charged, which at least includes an underlayer, characterized in that the following inequality holds $$\log(R) \geqq \log \&66\ Rp \times (Va - Vt)/Vt\} + (\alpha - \beta) \times \log(S/s) + \gamma \times \log(i/I)$$

where $|Va| \geqq |Vt|$

Va (V): voltage necessary for charging or discharging the member to be charged to a predetermined surface potential Vs (V)

I (μA): current necessary for charging or discharging the member to be charged to a predetermined surface potential Vs (V)

S ($cm^2$): contact area of the member to be charged and the charging member

R (Ω): resistance of the charging member when current I (μA) is fed to an area corresponding to the contact area S ($cm^2$) of the charging member γ: current dependency of the resistance of the charging member $1-\beta$: area dependency of the resistance of the charging member s ($cm^2$): area of a defective part of the member to be charged Vt (V): breakdown voltage of the underlayer i (μA): current flowing into an area corresponding to the contact area S ($cm^2$) of the underlayer when a voltage, slightly lower than the breakdown voltage Vt (V), is applied to that area Rp (Ω): resistance of the under layer when the current i (μA) flows into the an area corresponding to the contact area S ($cm^2$) of the underlayer when a voltage, slightly lower than the breakdown voltage Vt (V), is applied to that area $1-\alpha$: area dependency of the resistance of the underlayer.

10. A contact charging device for charging or discharging a member to be charged by bringing a charging member applied with an external voltage into contact with the member to be charged, which at least includes an underlayer, characterized in that the following inequality holds $$a + b \geqq Va \times 10^6/j$$

where $$\log(a) = \log(R) + (\beta - \gamma) \times \log(S/s) - \gamma \times \log(j/I)$$

$$\log(b) = \log(Rp) + \alpha \times \log(S/s)$$

in the above inequality,

Va (V): voltage necessary for charging or discharging the member to be charged to a predetermined surface potential Vs (V)

I (μA): current necessary for charging or discharging the member to be charged to a predetermined surface potential Vs (V)

S ($cm^2$): contact area of the member to be charged and the charging member

R (Ω): resistance of the charging member when current I (μA) is fed to an area of the charging member corresponding to the contact area S ($cm^2$)

γ: current dependency of the resistance of the charging member $1-\beta$: area dependency of the resistance of the charging member s ($cm^2$): area of a defective part of the member to be charged j (μA): current allowed to flow into an area corresponding to the area s ($cm^2$) of a defective part of the member to be charged Rp (Ω): resistance of the underlayer when the current $j \times S/s$ (μA) flows into an area corresponding to the contact area S ($cm^2$) of the underlayer $1-\alpha$: area dependency of the resistance of the underlayer.

11. A contact charging device for charging or discharging a member to be charged by bringing a charging member applied with an external voltage into contact with the member to be charged, characterized in that the following inequality holds $$\log(R) \geqq \log(Va \times 10^6/k) + (\gamma - \beta) \times \log(S/s) + \gamma \times \log(k/I)$$

where

Va (V): voltage necessary for charging or discharging the member to be charged to a predetermined surface potential Vs (V)

I (μA): current necessary for charging or discharging the member to be charged to a predetermined surface potential Vs (V)

S ($cm^2$): contact area of the member to be charged and the charging member

R (Ω): resistance of the charging member when current I (μA) is fed to an area of the charging member corresponding to the contact area S ($cm^2$)

γ: current dependency of the resistance of the charging member $1-\beta$: area dependency of the resistance of the charging member s ($cm^2$): area of a defective part of the member to be charged k (μA): current allowed to follow into a defective part of the member to be charged.

12. The contact charging device according to claim 11, wherein the capacity P (W) of a power source for supplying voltage to the charging member is given by $$P \geqq Va \times (I + k) \times 10^6.$$

13. The contact charging device according to any of claims 9, 10, 11, and 12, wherein the resistance R of the charging member is given by $$3 \times 10^8 \geqq R.$$

14. The contact charging device according to claim 13, wherein the voltage applied is formed by superposing an AC voltage on a DC voltage.

15. The contact charging device according to claim 13 wherein a layer is formed in the location of the charging member where the charging member comes in contact with the member to be charged, the major composition of the layer being any of urethane rubber, urethan resin, nylon resin and polyethylene resin.

16. The contact charging device according to any of claims 9, 10, 11 and 12, wherein the voltage applied is formed by superposing an AC voltage on a DC voltage.

17. The contact charging device according to claim 16, wherein a layer is formed in the location of the charging member where the charging member comes in contact with the member to be charged, the major composition of the layer being any of urethane rubber, urethan resin, nylon resin and polyethylene resin.

18. The contact charging device according to any of claims 9, 10, 11 and 12, wherein a layer is formed in the location of the charging member where the charging member comes in contact with the member to be charged, the major composition of the layer being any of urethane rubber, urethan resin, nylon resin and polyethylene resin.

19. The contact charge device of claim 11, wherein said member to be charged consists of a conductive layer and a dielectric layer arranged in this order.

20. A contact charging device for charging or discharging a member to be charged by bringing a charging member applied with an external voltage into contact with the member to be charged, which at least includes an intermediate layer, characterized in that the following inequality holds $$|Vb| \geqq |Va| \cdot Rbb/(Raa+Rbb)$$

where

Va (V): voltage necessary for charging or discharging the member to be charged to a predetermined surface potential Vs (V)

Vb: breakdown voltage of the intermediate layer of the member to be charged

Raa (Ω): resistance of a minute area of the charging member

Rbb (Ω): resistance of a minute area of the intermediate layer.

21. The contact charge device of claim 9, 10, 11 or 20, wherein said member to be charged consists of a conductive layer, said underlayer and a dielectric layer arranged in this order.

22. The contact charge device of claim 21, wherein said underlayer is formed of one of anodized aluminum and nylon resin.

23. The contact charge device of claim 9, 10, or 20, wherein said underlay is formed of one of anodized aluminum and nylon resin.

24. A contact transfer device for transferring developer onto a transferred-image recording media from a member to be charged when the transferred-image recording media passes through a space between a transfer member applied with an external voltage and the member to be charged, which at least includes an underlayer, characterized in that the following inequality holds $$\log(R) \geqq \log\{Rp \times (Va-Vt)/Vt\} + (\alpha-\beta) \times \log(S/s) + \gamma \times \log(i/I)$$

where $|Va| \geqq |Vt|$

Va (V): voltage applied to the transfer member

I (βA): current flowing from the transfer member to the member to be charged when the voltage Va (V) is applied to the transfer member in a state that the transferred-image recording media is absent between the transfer member and the member to be charged S ($cm^2$): contact area of the member to be charged and the transfer member in a state that the transferred-image recording media is absent between the transfer member and the member to be charged R (Ω): resistance of the transfer member when current I (μA) is fed to an area of the transfer member corresponding to the contact area S ($cm^2$)

γ: current dependency of the resistance of the transfer member $1-\beta$: area dependency of the resistance of the transfer member s ($cm^2$): area of a defective part of the member to be charged Vt (V): breakdown voltage of an underlayer i (μA): current flowing into an area of the underlayer corresponding to the area S ($cm^2$)

Rp (Ω): resistance of the area of the underlayer corresponding to the area S ($cm^2$)

$1-\alpha$: area dependency of the resistance of the underlayer.

25. A contact transfer device for transferring developer onto a transferred-image recording media from a member to be charged when the transferred-image recording media passes through a space between a transfer member applied with an external voltage and the member to be charged, which at least includes an underlayer, characterized in that the following inequality holds $$a+b \geqq Va \times 10^6/j$$

where $$\log(a) = \log(R) + (\beta-\gamma) \times \log(S/s) - \gamma \times \log(j/I)$$

$$\log(b) > \log(Rp) + \alpha \times \log(S/s)$$

in the above inequality,

Va (V): voltage applied to the transfer member

I (μA): current flowing from the transfer member to the member to be charged when the voltage Va (V) is applied to the transfer member in a state that the transferred-image recording media is absent between the transfer member and the member to be charged S ($cm^2$): contact area of the member to be charged and the transfer member in a state that the transferred-image recording media is absent between the transfer member and the member to be charged R (Ω): resistance of the transfer member when current I (μA) is fed to an area of the transfer member corresponding to the contact area S ($cm^2$)

γ: current dependency of the resistance of the transfer member $1-\beta$: area dependency of the resistance of the transfer member s ($cm^2$): area of a defective part of the charged member j (μA): current allowed to flow into an area of the underlayer corresponding to the defective part area s ($cm^2$)

Rp (Ω): resistance of the underlayer when the current $j \times S/s$ (μA) flows into an area of the underlayer corresponding to the contact area S ($cm^2$)

$1-\alpha$: area dependency of the resistance of the underlayer.

26. A contact transfer device for transferring developer onto a transferred-image recording media from a member to be charged when the transferred-image recording media passes through a space between a transfer member applied with an external voltage and the member to be charged, characterized in that the following inequality holds $$\log(R) \geqq \log(Va \times 10^6/k) + (\gamma - \beta) \times \log(S/s) + \gamma \times \log(k/I)$$

where

Va (V): voltage applied to the transfer member

I (μA): current flowing from the transfer member to the member to be charged when the voltage Va (V) is applied to the transfer member in a state that the transferred-image recording media is absent between the transfer member and the member to be charged S ($cm^2$) : contact area of the member to be charged and the transfer member in a state that the transferred-image recording media is absent between the transfer member and the member to be charged R (Ω): resistance of the transfer member when current I (μA) is fed to an area of the transfer member corresponding to the contact area S ($cm^2$)

$\gamma$: current dependency of the resistance of the transfer member $1-\beta$: area dependency of the resistance of the transfer member s ($cm^2$): area of a defective part of the member to be charged k (μA): current allowed to flow into a defective part of the member to be charged.

27. The contact transfer device of claim 24, 25 or 26, wherein said member to be charged consists of a conductive layer, said underlayer and a dielectric layer arranged in this order.

28. The contact transfer device of claim 24, 25 or 27, wherein said underlayer is formed of one of anodized aluminum layer and nylon resin layer.

29. The contact transfer device of claim 26, wherein said member to be charged consists of a conductive layer and a dielectric layer arranged in this order.

30. The contact transfer device of claim 24, 25 or 26, wherein said applied voltage Va is a voltage for transferring a developing agent to a recording medium.

31. The contact transfer device of claim 24, 25 or 26, wherein said applied voltage Va is a voltage for cleaning the transfer member.

* * * * *

UNITED STATES PATENT AND TRADEMARK OFFICE

CERTIFICATE OF CORRECTION

PATENT NO. : 5,359,395
DATED : October 25, 1994
INVENTOR(S) : Hidetsugu SHIMURA et al.

It is certified that error(s) appears in the above-identified patent and that said Letters Patent is hereby corrected as shown below:

Col. 5, line 1, change "log (a))" to --log (a)--.

Col. 4, lines 60-61, delete the equation and insert the following:

$$-\log(R) \geq \log\{Rp \times (Va - Vt)/Vt\}$$
$$+(\alpha - \beta) \times \log(S/s) + \gamma \times \log(i/I) \text{ --.}$$

Col. 14, line 16, change "log (55 k" to --log {k--.

Col. 24, line 41, change "-22.2" to -- =-22.2 --.

Col. 48, line 1, change "log (55 Rp" to --log {Rp--.

Col. 48, line 4, change "where |Va| |Va| ≥ |Va| |Vt|" to --where |Va| ≥ |Vt|--.

Col. 48, lines 13-14, delete equation (C) and insert the following:

$$-\log(R) \geq \log(Va \times 10^6/k)$$
$$+(\gamma - \beta) \times \log(S/s) + \gamma \log(k/I) \text{ --.}$$

UNITED STATES PATENT AND TRADEMARK OFFICE

CERTIFICATE OF CORRECTION

PATENT NO. : 5,359,395 
DATED : October 25, 1994
INVENTOR(S) : Hidetsugu SHIMURA et al.

It is certified that error(s) appears in the above-identified patent and that said Letters Patent is hereby corrected as shown below:

Col. 49, line 30, change "where $|Va \geq |Vt|$" to --where $|Va| \geq |Vt|$--.

Col. 49, lines 25-27, delete the equation and insert the following:

$$-- \log (R) \geq \log \{Rp \times (Va - Vt)/Vt\}$$
$$+ (\alpha - \beta) \times \log (S/s) + \gamma \times \log (i/I) \ --.$$

Col. 51, lines 15-16, delete the equation and insert the following:

$$-- \log (R) \geq \log \{Rp \times (Va - Vt)/Vt\}$$
$$+ (\alpha - \beta) \times \log (S/s) + \gamma \times \log (i/I) \ --.$$

Col. 52, lines 26-28, delete the equation and insert the following:

$$-- \log (R) \geq \log (Va \times 10^6/k)$$
$$+ (\gamma - \beta) \times \log (S/s) + \gamma \log (k/I) \ --.$$

UNITED STATES PATENT AND TRADEMARK OFFICE

CERTIFICATE OF CORRECTION

PATENT NO. : 5,359,395 Page 3 of 3
DATED : October 25, 1994
INVENTOR(S) : Hidetsugu SHIMURA et al.

It is certified that error(s) appears in the above-identified patent and that said Letters Patent is hereby corrected as shown below:

Col. 53, lines 60-61, delete the equation and insert the following:

$$-- \log (R) \geq \log \{Rp \times (Va - Vt)/Vt\}$$
$$+ (\alpha - \beta) \times \log (S/s) + \gamma \times \log (i/I) \ --.$$

Col. 54, line 38, change "log (b) > log (Rp)" to --log (b) = log (Rp)--.

Col. 55, lines 10-11, delete the equation and insert the following:

$$-- \log (R) \geq \log (Va \times 10^6/k)$$
$$+ (\gamma - \beta) \times \log (S/s) + \gamma \times \log (k/I) —.$$

Signed and Sealed this

Fourteenth Day of March, 1995

*Attest:*

Bruce Lehman

BRUCE LEHMAN

*Attesting Officer*

*Commissioner of Patents and Trademarks*